US008261661B2

(12) United States Patent
Masuch et al.

(10) Patent No.: US 8,261,661 B2
(45) Date of Patent: Sep. 11, 2012

(54) PRINTING PRESS HAVING AT LEAST ONE POWER CONTROLLED ACTUATOR FOR ADJUSTING A PRINT-ON POSITION

(75) Inventors: Bernd Kurt Masuch, Kürnach (DE); Karl Robert Schäfer, Kürnach (DE); Georg Schneider, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 973 days.

(21) Appl. No.: 11/918,320

(22) PCT Filed: Apr. 20, 2006

(86) PCT No.: PCT/EP2006/061693

§ 371 (c)(1), (2), (4) Date: Nov. 12, 2008

(87) PCT Pub. No.: WO2006/111555

PCT Pub. Date: Oct. 26, 2006

(65) Prior Publication Data

US 2009/0217832 A1 Sep. 3, 2009

(30) Foreign Application Priority Data

Apr. 21, 2005 (DE) ..... 10 2005 018 473
Sep. 27, 2005 (DE) ..... 10 2005 045 985

(51) Int. Cl.
*B41F 13/24* (2006.01)
*B41F 13/40* (2006.01)

(52) U.S. Cl. ..... 101/216; 101/247

(58) Field of Classification Search ..... 101/216, 101/217, 218, 183, 184, 185, 247
See application file for complete search history.

(56) References Cited

U.S. PATENT DOCUMENTS 4,119,031 A 10/1978 Ottenhues
4,690,052 A 9/1987 Paulsen
4,905,598 A 3/1990 Thomas et al.
5,181,468 A * 1/1993 Borel ..... 101/216
5,275,099 A * 1/1994 Kawagoe ..... 101/216
(Continued)

FOREIGN PATENT DOCUMENTS

CH 470 967 5/1969
(Continued)

OTHER PUBLICATIONS

Office Action, Japanese Patent Office, issued on Oct. 28, 2010.

*Primary Examiner* — Leslie J Evanisko
(74) *Attorney, Agent, or Firm* — Mattingly & Malur, P.C.

(57) ABSTRACT

A printing unit is comprised of at least two cylinders which cooperate with each other in a printing group. At least one of these at least two cylinders is movably mounted so that it can be positioned against the other of the at least two cylinders by the use of at least one actuator, which is preferably configured as a power-controlled actuator. A control device is provided and in which several different preset values, which represent different levels of contact force between the two cylinders, are stored. Such data storage is in accordance with a criterion which concerns machine data and/or consumed material data and/or operational data. This data is usable to position the cylinder by operation of the actuator.

19 Claims, 20 Drawing Sheets

U.S. PATENT DOCUMENTS

| | | | | |
|---|---|---|---|---|
| 6,098,542 | A | 8/2000 | Dufour | |
| 6,167,806 | B1 | 1/2001 | Chretinat et al. | |
| 6,668,719 | B2 | 12/2003 | Reder et al. | |
| 7,011,023 | B2 | 3/2006 | Dittenhofer et al. | |
| 7,117,792 | B2 | 10/2006 | Faist et al. | |
| 7,124,683 | B2 | 10/2006 | Faist et al. | |
| 2002/0096070 | A1 * | 7/2002 | Friedrichs et al. | 101/247 |
| 2004/0252928 | A1 | 12/2004 | Dittenhofer et al. | |
| 2005/0072328 | A1 * | 4/2005 | Gilliam et al. | 101/247 |

FOREIGN PATENT DOCUMENTS

| | | | |
|---|---|---|---|
| DE | 1 561 014 | | 2/1970 |
| DE | 26 38 750 | | 3/1978 |
| DE | 35 29 680 | A1 | 3/1986 |
| DE | 88 03 310 | | 7/1988 |
| DE | 195 34 651 | A1 | 3/1997 |
| DE | 100 01 582 | A1 | 8/2000 |
| DE | 199 63 944 | C1 | 6/2001 |
| DE | 101 45 322 | A1 | 4/2003 |
| DE | 102 44 043 | A1 | 6/2003 |
| EP | 0 331 870 | A2 | 1/1989 |
| EP | 0 941 850 | A1 | 1/1999 |
| GB | 890943 | | 3/1962 |
| GB | 1 213 903 | | 11/1970 |
| JP | 4-327941 | | 11/1992 |
| JP | 10-180978 | | 7/1998 |
| JP | 2004-148686 | | 5/2004 |
| WO | WO 02/081218 | A2 | 10/2002 |
| WO | WO 03/025406 | A1 | 3/2003 |

* cited by examiner

PRINTING PRESS HAVING AT LEAST ONE POWER CONTROLLED ACTUATOR FOR ADJUSTING A PRINT-ON POSITION

CROSS-REFERENCE TO RELATED APPLICATIONS

This application is the U.S. national phase, under 35 USC 371, of PCT/EP2006/061693, filed Apr. 20, 2006; published as WO 2006/111555 A2 and A3 on Oct. 26, 2006 and claiming priority to DE 10 2005 018 473.1, filed Apr. 21, 2005 and to DE 10 2005 045 985.4, filed Sep. 27, 2005, the disclosures of which are expressly incorporated herein by reference.

FIELD OF THE INVENTION

The present invention is directed to printing units and to methods for adjusting a print-on position. The printing units have at least two cylinders which coordinate in a printing couple. At least one of the cylinders is movable such that it can be moved into and out of engagement with the other cylinder by an actuator.

BACKGROUND OF THE INVENTION

DE 195 34 651 A1 describes a printing unit with cylinders that lie within a single plane. Three of four cylinders are mounted so as to be linearly movable along the cylinder plane for print-on and/or print-off adjustment. The cylinders are mounted in guide elements which are arranged on the inner panel of the frame. The cylinders are seated in supports on the shared guide elements, and can be engaged against one another and can be disengaged from one another by the use of pneumatically operated actuator cylinders. By using actuator cylinders, differences in the printing substrate thickness and temperature factors can be compensated for.

In WO 02/081218 A2, separate linear bearings for two transfer cylinders, which are mounted in sliding frames, are known. An actuator for the sliding frames can be structured as a pneumatically actuated cylinder. In order to define an end position for the adjustment movement, which adjustment movement extends transversely in relation to the cylinder plane, an adjustable stop is provided.

WO 03/025406 A1 describes a bearing arrangement for cylinders. A sliding frame, that encompasses a linear guide, can be moved by a pneumatic, electric or hydraulic actuator arranged on the frame.

DE 88 03 310 U describes a printing couple with two cylinders. At least one of the cylinders can be engaged against the other cylinder by an actuator that can be acted upon by an adjustable level of pressure. A pneumatic line that supplies the actuator is connected to an adjustment, preselection, control or regulating device. The pressure can be adjusted, for example, to correspond to the press speed of the cylinders. For example, a lower pressure can be allocated to a lower speed and a higher pressure can be allocated to a higher speed.

In DE 199 63 944 C1, a device and a method for adjusting a first roller, in relation to a second roller, is described. The first roller can first be engaged against the second roller at a pre-selectable contact force with a stop is released, and, once the stop has been positioned, can be pressed against the stop with a significantly higher "fastening force." The drives and actuators can be controlled via a control device. The target values for the presettable pressures are adjustable. With this process, the rollers can be rapidly preset, even to compensate for both diameter changes over the course of production and/or for Shore hardness changes.

In GB 890 943 A, a printing press that operates using the direct printing process is described. A forme cylinder can be pneumatically engaged against an impression cylinder. A contact force that is higher in relative terms is advantageous for normal materials fed through the forme cylinder and impression cylinder, whereas a lower contact force is advantageous for very thin materials. The adjustment is accomplished by the use of fluid-powered correcting elements. The higher or lower engagement pressure can be selectively implemented via valves.

DE 26 38 750 A1 also concerns a printing couple that operates using the direct printing process. By adjusting precision regulator valves, based upon the engraving of the print image, the corresponding forces between the impression cylinder and the forme cylinder are selected.

SUMMARY OF THE INVENTION

The object of the present invention is to provide printing units and methods for adjusting a print-on position.

The object is attained according to the invention by the provision of printing units, each with at least two cylinders that coordinate in a printing couple. At least one of the cylinders in each printing unit is movably mounted so that it can be engaged against the other unit by an actuator. The actuator is a power-controllable actuator. A control device is provided and stores a plurality of different default values which represent different levels of contact force. These are based on a criterion related to machine data, consumable product data or operational data. These values are used to represent contact forces for different input values which characterize a property of the substrate to be printed.

The benefits to be achieved in accordance with the present invention consist especially in that a contact force that is optimal for respective conditions can be established at the nip points of the printing couple without major mechanical intervention. It is not necessary for the adjustment to be accomplished via indirect, displacement-induced processes. Therefore it can be easily performed by the operating staff. In the past, cost has frequently been a negative deciding factor, and despite different conditions, such as, for example, different paper properties, printing has been performed using a single setting as a compromise. With the embodiment of the present invention, it is no longer necessary to make do without an adjustment due to the high cost, and is no longer necessary to print in a compromise setting.

In general, an advantage of the present invention is that a particularly simple, focused adjustment of the printing couple cylinders, that is directly relevant to the printing technology, is provided.

The benefits to be achieved with the present invention also consist in that a printing unit that is easy to produce and/or easy to operate is provided. This printing unit simultaneously offers high print quality.

Of particular advantage is that the printing couple cylinders can be adjusted with a predefined level of force. In other words, the printing couple cylinders can be power-controlled.

The embodiment of a linear bearing with movable stops enables a pressure-based adjustment of the cylinders. It also provides an automatic basic setting adjustment, for a new configuration, a new blanket, a different substrate, such as, for example, a type of paper and the like.

By employing linear guides for the printing couple cylinders, an ideal installation position for the cylinders, with respect to potential cylinder vibrations, is achieved. In addition, by seating the cylinder bearing in linear guides, short adjustment paths are realized. Therefore no synchronizing spindles are necessary. The costly incorporation of triple-ring bearings is eliminated.

On the inside of the side frames, the same cylinder bearings, which do not extend all the way through the frames, enable side frame mounting without specific bearing bores. In addition to simple installation, mounting on the inside of the side frames also enables the shortening of the cylinder journals, which serves to reduce vibration.

BRIEF DESCRIPTION OF THE DRAWINGS

Preferred embodiments of the present invention are represented in the drawings and are described in greater detail in what follows.

The drawings show.

DESCRIPTION OF THE PREFERRED EMBODIMENTS

Figure 1:
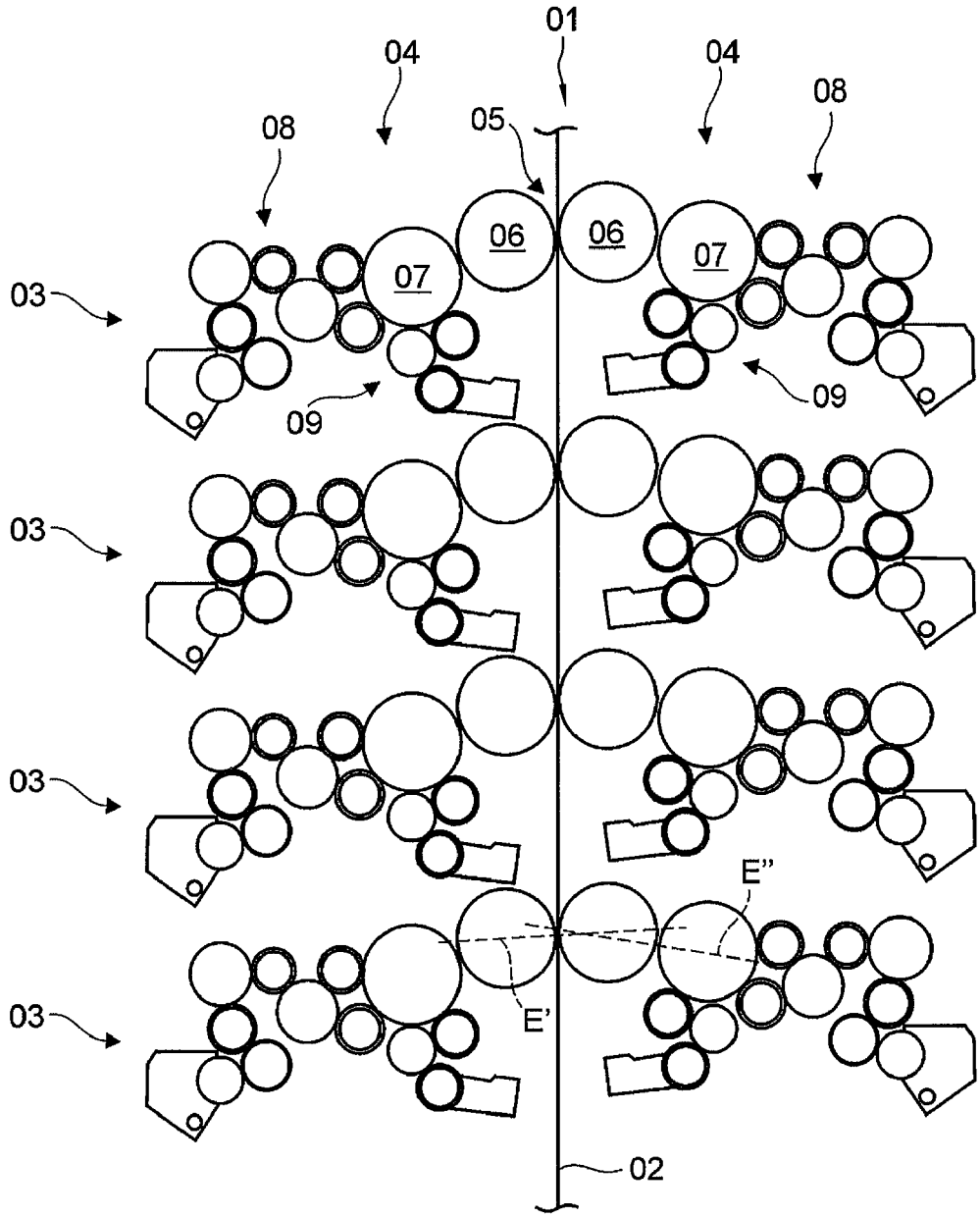
FIG. 1 a schematic representation of a printing unit with a plurality of printing couples.

A printing press, such as, for example, a web-fed rotary printing press, and especially a multicolor web-fed rotary printing press, as may be seen schematically in FIG. 1 has a printing unit 01, in which a substrate 02, such as, for example, a web of material 02, which will be referred to hereinafter as web 02, can be printed on both sides in a single-step process, or especially can be printed on both sides in succession in a multi-step process, such as, for example, in this case four times. Alternatingly, a plurality of webs can be printed simultaneously, in a single- or a multi-step process, by printing couples 04. One or more printing units 01 and/or printing couples 04 can also be provided, in which a web 02 can be printed, on only one side at the printing point 05. The printing couples 04 have printing couple cylinders 06; 07, which are engaged against one another in pairs in the print-on position.

The process methods and/or devices, which will be described in what follows, can also be advantageously applied to printing couples 04 in which the substrate 02 is configured not in web form, but as sheets.

What is important in the context of the present invention is that one or more of the printing couple cylinders 06; 07, at least for a period of adjustment of a travel-limiting stop, can be engaged against one another via a powered adjustment. In this manner, a engagement position that is based directly upon the parameters "force" and/or "contact pressure", which are relevant to printing, is found. Such a position is not determined via an alternate route, such as the measurement and adjustment of the width of a printing test strip.

The mounting and the actuation mechanism for this functional principle can be configured in a multitude of ways and will be described in greater detail in what follows. This principle can be applied to printing couples 04 and/or to printing units 01 in the widest range of configurations. The application of the functional principle is described in the context of an advantageous embodiment of a printing unit 01 or in the context of an advantageous embodiment of a printing couple 04.

In the example depicted in FIG. 1, the printing unit 01 has a plurality of blanket-to-blanket printing couples 03, in the present case four such printing couples 03, which are arranged vertically, one on top of another, for double-sided printing in blanket-to-blanket operation. The blanket-to-blanket printing couples 03, which are represented in FIG. 1 in the form of arch-type or n-printing couples, are each formed by two printing couples 04, each of which printing couples has cylinders 06; 07, one cylinder being configured as a transfer cylinder 06 and one cylinder being configured as a forme cylinder 07, e.g. printing couple cylinders 06; 07. Each printing couple 04 has an inking unit 08 and, in the case of wet offset printing, a dampening unit 09. In each case, between the two transfer cylinders 06, in the engaged position, a blanket-to-blanket printing point 05 is formed. The components described above are identified only on the uppermost blanket-to-blanket printing couple 03 in FIG. 1. The blanket-to-blanket printing couples 03; 04, which are depicted in FIG. 1 as being arranged one on top of another, are essentially identical in configuration, especially in the embodiment of the particular features that are relevant to the present invention. The blanket-to-blanket printing couples 03 can also be configured differently from the representation in FIG. 1. For example, the printing couples can be configured as a U-shaped unit that is open toward the top without the advantageous feature of linear arrangement, which will be described below.

Figure 2:
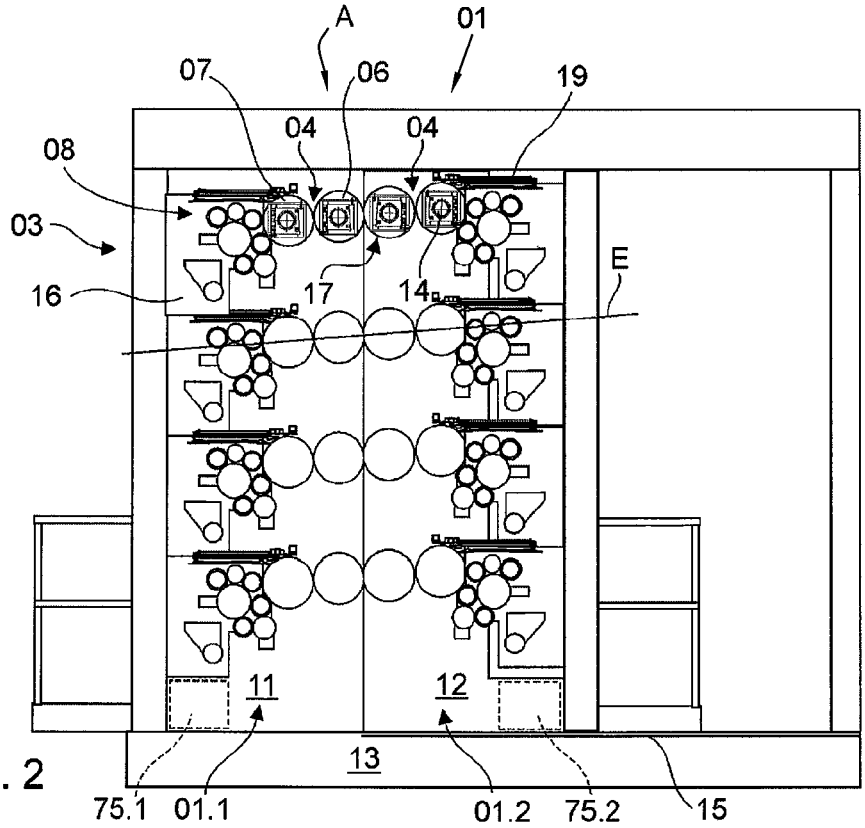
FIG. 2 a first operating position for a separable printing unit.
Figure 3:
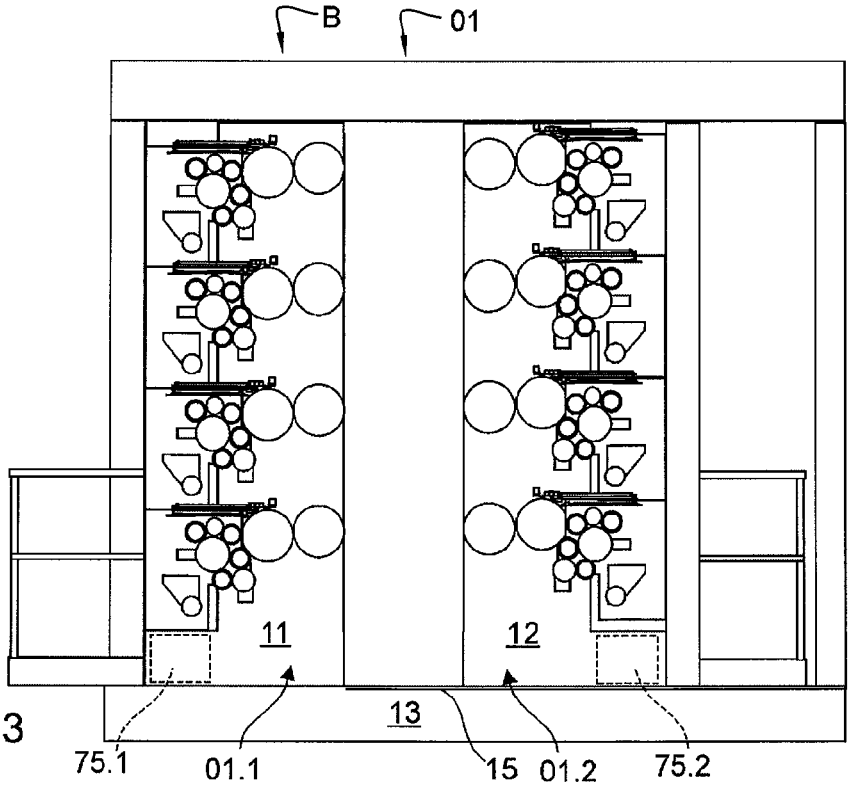
FIG. 3 a second operating position for a separable printing unit.
Figure 4:
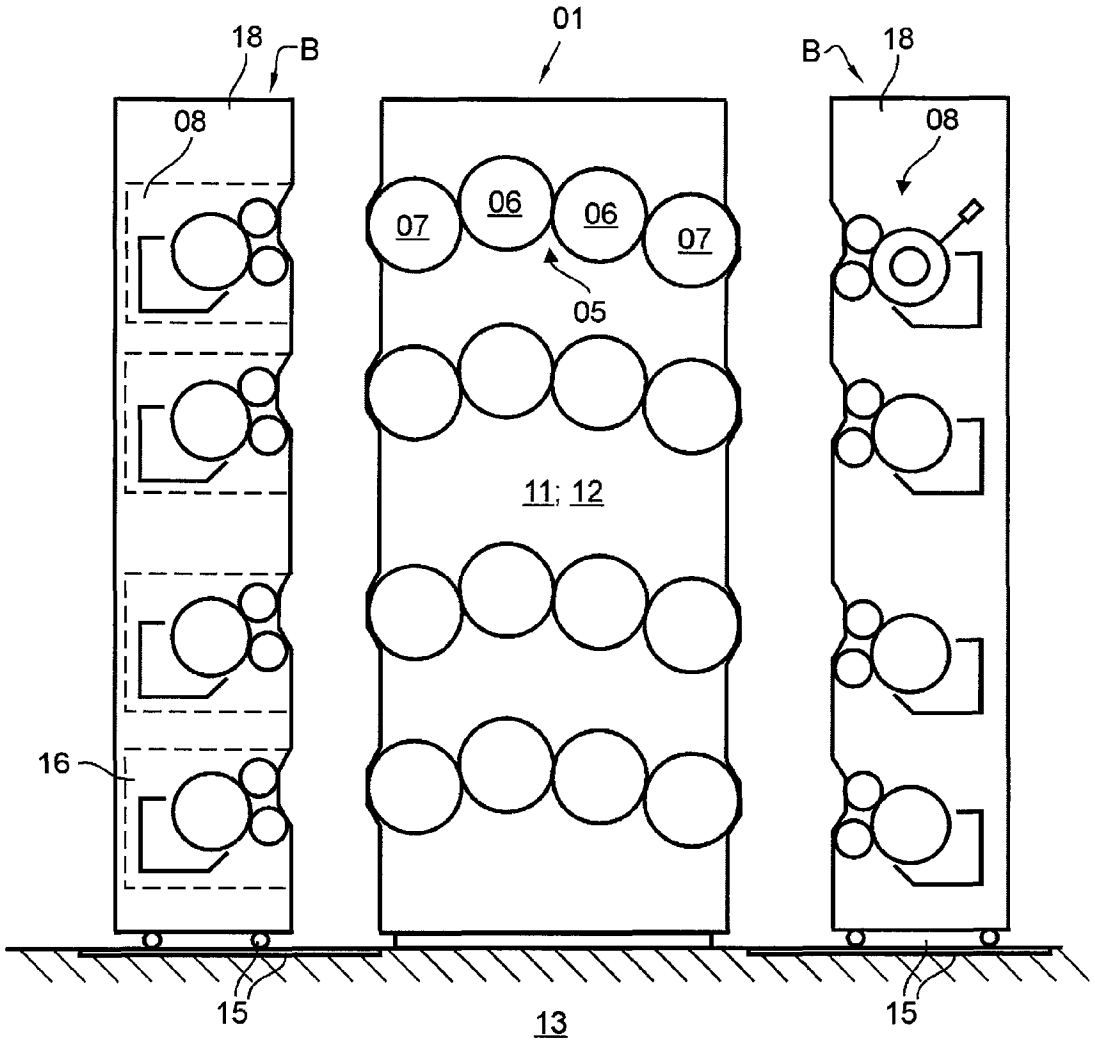
FIG. 4 a variation of a separable printing unit.

As depicted in FIGS. 2 and 3, in one advantageous embodiment, for example, the printing unit 01 can be positioned centrally, and can be separable in the area of the blanket-to-blanket printing points 05. It can also be configured, as shown in FIG. 4, to be functionally separated between the forme cylinders 07 and the inking couples 08. Additionally, as seen in FIGS. 2 and 3, two systems 75.1; 75.2 for use in supplying pressure medium, and which will be described in greater detail below, are indicated, by way of example.

As also indicated, by way of example in FIGS. 2 and 4, the inking couples 08, and if applicable the dampening units 09 can be configured as modules that each comprise a plurality of rollers and which have their own frame 16 or frame structure 16, and which can be configured to be used as modules that can be pre-mounted in the printing unit 01. As will be described in greater detail below, the printing unit cylinders 06; 07 can be configured as pre-mountable or as pre-mounted cylinder units 17, with bearing units 14 allocated to them. In an advantageous embodiment of the present invention, in the print-on position, the rotational axes of the printing couple cylinders 06; 07 in a printing couple 04 can be configured to lie essentially within a shared plane E. The shared plane E forms an angle, for example measuring between 76° and 87°, especially between 80° and 85°, with the plane of the web being fed into the printing couple.

In the depiction shown in FIGS. 2 and 3, an advantageous embodiment of the printing unit 01, in accordance with the present invention, is represented. The printing unit 01 is configured, in the area of its blanket-to-blanket printing points 05, to be functionally separable, such as, for example for set-up and maintenance purposes, as opposed to being separable for disassembly or dismantlement. The two sections that can be separated from one another are identified here as printing unit sections 01.1 and 01.2.

To this end, the printing couple cylinders 06; 07 of the plurality, such as, for example, four of the blanket-to-blanket printing couples 03 arranged one above another, are rotatably mounted in or on one right and one left frame or wall section 11; 12, such as, for example, a side frame 11; 12, such that the two printing couple cylinders 06; 07 of one printing couple 04 are allocated to the same frame or wall section 11; 12. Preferably, the printing couple cylinders 06; 07 of multiple, and especially all of the printing couples that print on the same side of a web 02, are mounted on the same frame or wall section 11; 12. In principle, the printing couple cylinders 06; 07 can be mounted on only one side, or can be cantilevered, on only one end surface frame section 11. Preferably, however, two frame sections 11; 12, which are arranged at the end surfaces of the cylinders 06; 07 are provided for each printing unit section 01.1; 01.2. The two printing unit sections 01.1; 01.2 that can be separated from one another comprise the respective frame sections 11; 12 and the respective printing couples 04, including printing couple cylinders 06; 07 and inking couples 08.

The printing unit sections 01.1; 01.2 can be moved toward one another or can be moved away from one another in a direction extending perpendicular to the rotational axes of the cylinders 06; 07. One of the two sections is preferably mounted fixed in space, in this case printing unit section 01.1, for example by being fixed stationarily on a section of floor 13 in the printing shop, on a stationary support 13, on a mounting plate 13 or on a mounting frame 13 for the printing unit 01. The other of the two sections, in this case printing unit section 01.2 is mounted so as to be movable in relation to the floor 13 or support 13 or mounting plate 13 or mounting frame 13, hereinafter referred to as support 13.

To this end, the outer frame sections 12 are mounted in bearing elements of the frame section 12 and in bearing elements of the support 13, which bearing elements correspond to one another and which are not shown here, and which together are forming a linear guide 15. These bearing elements, forming a linear guide 15, can be configured as rollers that run on tracks or as slider- or roller-mounted linear guide elements that are allocated to one another.

The wall sections 11; 12 are preferably structured such that in their operational position A, as depicted in FIG. 2 their facing sides are configured to have essentially complementary shapes in pairs, and to nevertheless form an essentially closed side front at their separation lines and/or at their contact or impact lines, when pushed together.

FIG. 3 shows a maintenance position B for the printing unit 01, and without a depiction of the bearing units 14 shown in FIG. 2, wherein the positioning of the printing unit sections 01.1; 01.2, in relation to one another, is effected by moving the frame sections 12. In principle, this relative positioning can also be accomplished, in another embodiment, in which both printing unit sections 01.1; 01.2 and/or their frame sections 11; 12 are mounted so as to be movable.

In one variation of the present invention, as may be seen in FIG. 4, and which is a depiction of a separable printing unit 01, the side frame 11; 12 is not separable in the sense that the printing couple cylinders 06; 07 are separated at the printing point 05. Instead, the printing couple cylinders 06; 07 are inseparably mounted in, or on a shared side frame 11; 12. At both sides of the printing cylinder couples, the wall sections 18 that support the inking couples 08 can be placed in an operational position A, not shown or a maintenance position B, as is shown. In this configuration, separation occurs between forme cylinder 07 and inking unit, or if applicable, dampening unit 08, 09.

In one advantageous format embodiment, forme and transfer cylinders 07; 06 can be configured to each have a barrel width of at least four or even six vertical printed pages in newspaper format, and especially in broadsheet format, arranged side by side. Such a cylinder barrel width is particularly beneficial for accomplishing a high product output. For example, a double-width web 02 can be printed with four newspaper pages side by side using a four wide cylinder barrel, and a triple-width web 02 can be printed with six newspaper pages side by side, using a six wide cylinder barrel and the forme cylinder 07 can be loaded accordingly with four or with six printing formes situated side by side, respectively, especially with their ends in alignment with one another. In a first format embodiment, the cylinders 06; 07 have a circumference that corresponds essentially to two printed pages in newspaper format, especially in broadsheet format, and arranged in tandem.

In the configurations of the printing unit 01 with forme cylinders 07 of double-sized format, two newspaper pages in tandem in circumference, the printing unit advantageously has two channels that are configured to accommodate the printing formes. Such cylinder channels are often offset in a circumferential direction 1802 in relation to one another, and preferably are configured to extend continuously over the entire effective barrel length. The forme cylinder 07 can then be loaded with four or with six printing formes positioned side by side, respectively, and in each case with two printing formes being arranged in tandem.

In one embodiment, with a double-sized format, with two newspaper pages arranged in tandem in circumference the transfer cylinder 06 has, for example, only one channel for use in accommodating one or more printing blankets which are arranged side by side, with that channel being preferably configured to extend continuously over the entire effective barrel length. The transfer cylinder 06 can then be loaded with one printing blanket that is continuous over the entire transfer cylinder barrel length and which also extends over essentially the entire transfer cylinder barrel circumference, or with two or three printing blankets situated axially side by side, with each blanket extending over essentially the entire circumference of the transfer cylinder barrel. In another embodiment of the double-sized transfer cylinder 06, that cylinder can have two or three printing blankets arranged side by side, wherein the respective adjacent blankets are offset 180° in relation to one another, in a circumferential direction of the transfer cylinder barrel. These printing blankets, which are offset from one another, can be held in two or in three channel sections, which channel sections are also side by side in the longitudinal direction of the cylinder 06, whereas the respective adjacent channel sections are offset 180° from one another in a circumferential direction of the barrel of the transfer cylinder 06.

In another embodiment, the cylinders 06; 07 can also be configured to have a single-sized circumference, with one printed page, and especially with a newspaper page, in a circumferential direction. The transfer cylinder 06 can also be configured with a double circumference and the forme cylinder 07 can be configured with a single circumference. In printing couples 04 for use in commercial printing, the cylinders 06; 07 can also be configured to have circumferences that correspond to four horizontal tabloid pages.

In principle, the inking couple 08 can be configured in various ways. For instance, it can be configured as represented, by way of example, in FIG. 1, as a single-train roller inking couple 08, e.g. with two distribution cylinder, such as, for example, for newspaper printing, or as shown by way of example in FIGS. 2 and 3 as anilox inking couples 08 that utilize an anilox roller that is equipped with cells or grid marks. In an embodiment which is not specifically shown, it can also be configured as a roller inking couple 08 with two inking trains and with, for example, three distribution cylinders, for use in, for instance, commercial printing.

In the case of dry offset printing, one inking couple 08 is provided for each printing couple 04. However, no dampening unit 09 is provided. In wet offset printing, dampening agent is supplied via the dampening unit 09, which may be strictly separated from the inking couple 08 or which may be connected in parallel to the inking couple 08 via an arch-type roller.

The dampening unit 09 can be structured as a dampening unit 09 with at least three rollers, as represented in FIG. 1. Preferably, the dampening unit 09 is configured as a so-called contactless dampening unit 09, and especially as a spray dampening unit 09. As is also indicated in FIGS. 2 and 3, the printing couples 04 can each have a printing forme manipulating device 19, which is usable to provide support to printing formes for printing forme changes. In a preferred embodiment, the manipulating device 19 is configured as an at least partially automatic or even as a fully automatic printing forme changer 19.

Independent of the advantageous configuration of each bearing as a bearing unit 14, as will be described below, and its special structure and arrangement, an adjustment of printing couple cylinders 06; 07 to the print-on position, or at least a print-on adjustment, is implemented within the framework of the pre-setting of a travel-limiting stop. This is accomplished by the use of at least one actuator 43, and especially by the use of a power-controlled actuator 43 or one that is defined by a force. By the use of such an actuator, a defined or definable force F can be applied to the cylinders 06; 07 or to their journals in the print-on direction to effect adjustment. The linear force $F_L$ at the nip points 05, which force is decisive for ink transfer and therefore for print quality among other factors, is therefore defined not by an indirect parameter, such as a measured test printing strip. Instead, it is defined by the equilibrium of forces between the force F and the linear force $F_L$ that results between the cylinders 06; 07, and the resulting equilibrium.

To adjust the basic setting of a system, in one advantageous embodiment it is therefore provided that within a certain time during adjustment, at least one cylinder 06 (07) can be engaged, solely power-driven, against the adjacent cylinder 07 (06), without effective limitation of travel to the printing point. Advantageously, at least during a certain time period during the adjustment process, a cylinder 06 that is involved at the printing point 05 can be fixed in a defined position, and advantageously can be fixed in the engaged position determined by the equilibrium of forces, or at least can be limited in terms of its travel in the direction of the printing point 05.

In what follows, the above-described principle of power-controlled positioning, at least during the adjustment process will be described in the context of advantageous embodiments for mounting and for the actuation mechanism.

Figure 5:
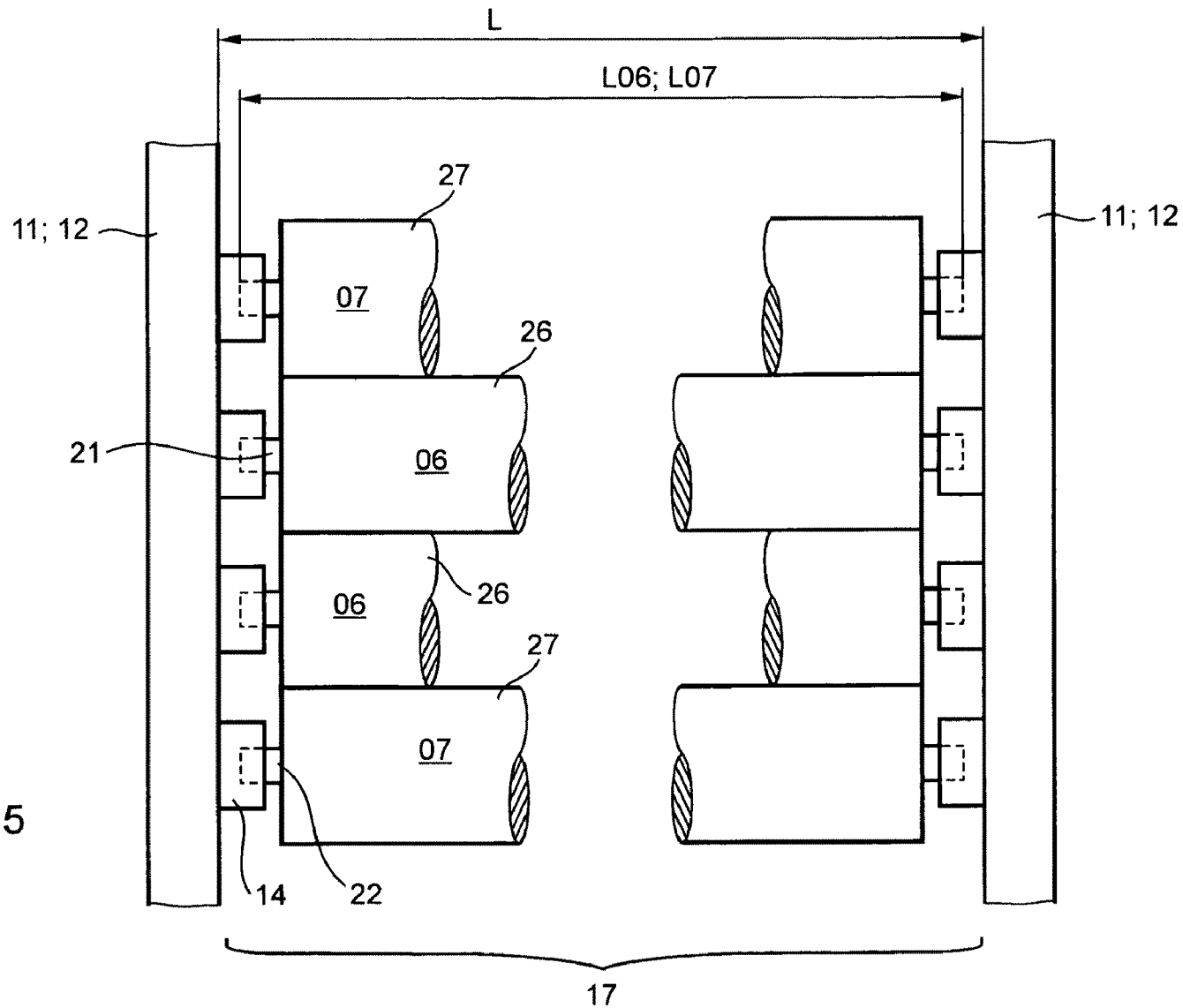
FIG. 5 a top plan view of a blanket-to-blanket printing couple.

FIG. 5 shows a top plan view of the side frames 11, 12 for support of cylinders 06; 07, which are rotatably mounted in bearings 14. In the embodiment having modules configured as cylinder units 17, as will be discussed below, with reference to FIG. 5 and FIG. 6, these cylinder units 17 have, for example, a cylinder 06; 07 with journals 21; 22 and a bearing unit 14 that is already pre-mounted on the journals 21; 22 and which is prestressed and/or pre-adjusted. Bearing unit 14 and cylinders 06; 07 receive their firmly defined position, in relation to one another, prior to installation in the printing unit 01, and can be installed in the printing unit 01 as a single component.

In one advantageous embodiment of the printing unit 01 in accordance with the present invention, it is provided that the cylinders 06; 07 are rotatably mounted in bearing units 14 on the side frames 11; 12. These bearing units 14 do not extend all the way through the alignment of the side frames 11; 12, and/or the barrels 26; 27 of the respective cylinders 06; 07, including their journals 21; 22, have a length L06; L07 that is smaller than or that is equal to an inside width L between the side frames 11; 12 that support the printing couple cylinders 06; 07 at both end surfaces, as is seen in FIG. 5. The side frames 11; 12 that support the printing couple cylinders 06; 07 at both end surfaces preferably are not side frames that are open at the sides such that the cylinders 06; 07 could be removed axially. Rather, they are side frames 11; 12 that, in an axial direction, at least partially overlap the end surface of the mounted cylinder 06; 07, i.e. the cylinder 06; 07, especially its bearing, as will be discussed below, is at least partially enclosed at its end surface by the two side frames 11; 12.

Preferably, each of the four printing couple cylinders 06; 07, but at least three of the printing couples has its own bearing unit 14, into which the on/off adjustment mechanism is already integrated. Bearing units 14 that are equipped with the on/off adjustment mechanism can also be provided for three of the four cylinders 06; 07, while bearing units 14 without the on/off adjustment mechanism are provided for the fourth cylinder.

Figure 6:
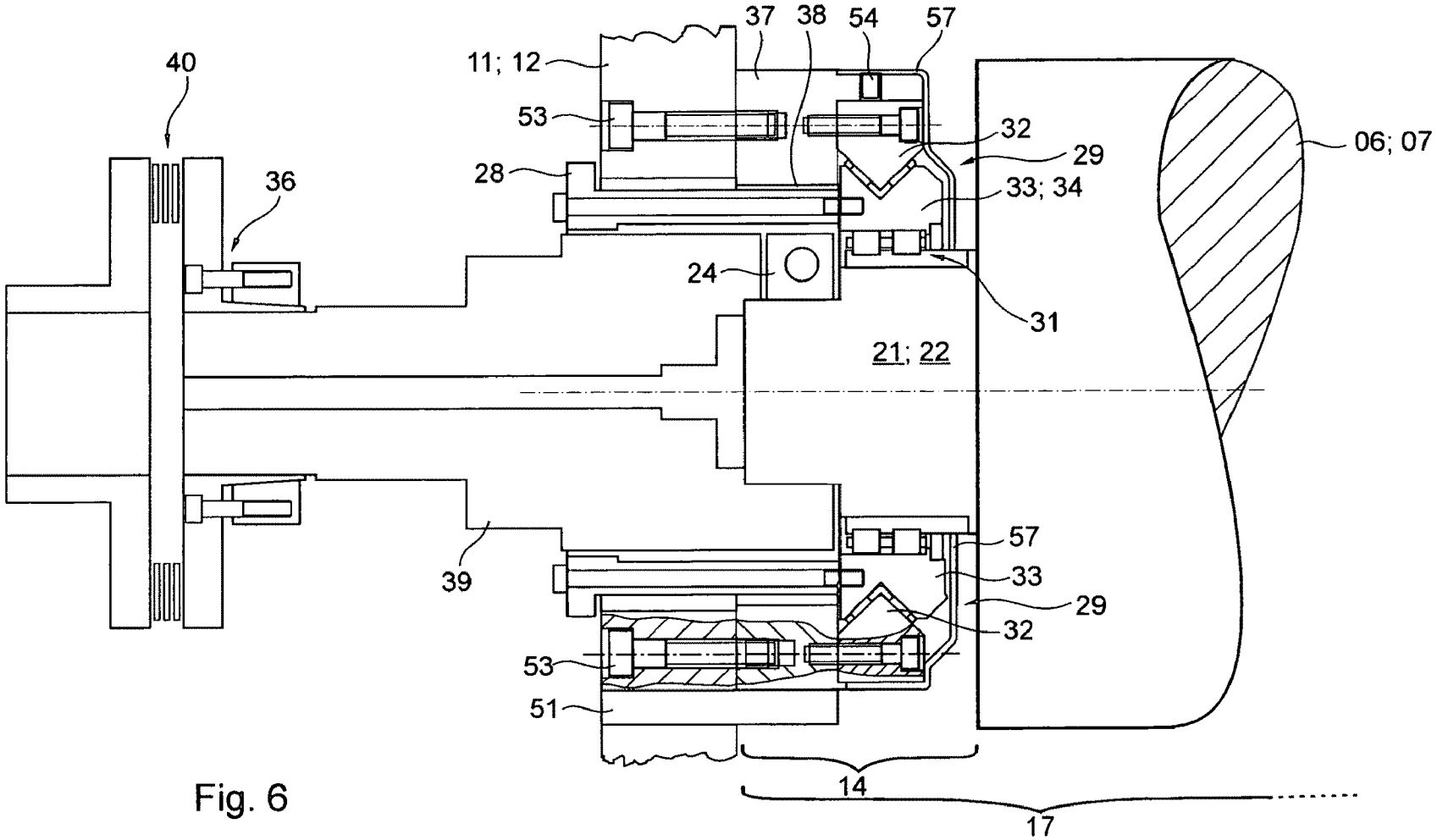
FIG. 6 a schematic longitudinal section of a bearing unit for a printing couple cylinder.
Figure 7:
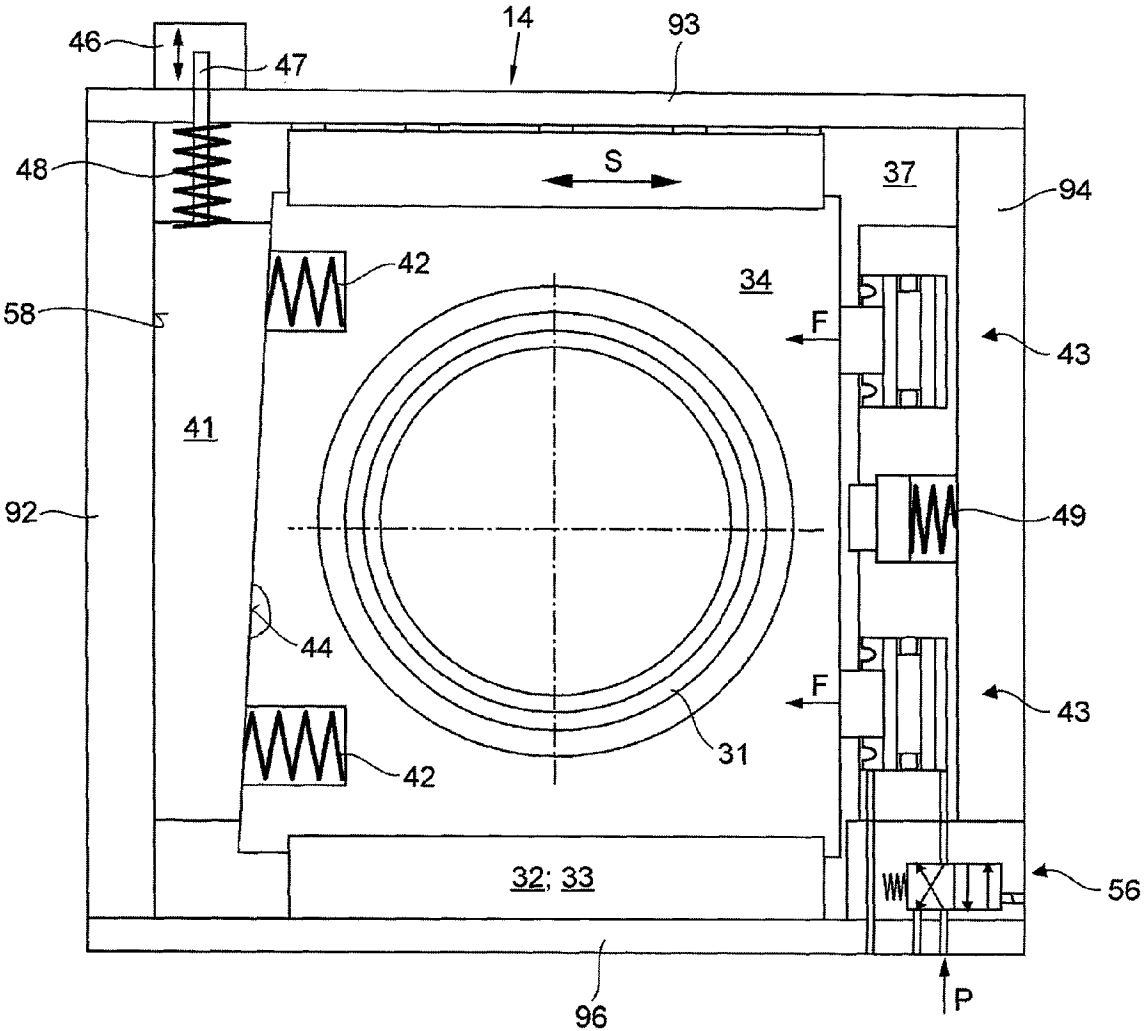
FIG. 7 a schematic cross-section of a bearing unit.

FIGS. 6 and 7 show, in schematic longitudinal and cross sections, a bearing unit 14 that is preferably based upon linear adjustment pathways. The bearing unit 14 that integrates the on/off adjustment mechanism, in addition to having a bearing 31, such as, for example, a radial bearing 31, and specifically for example a cylindrical roller bearing 31, for the rotational bearing of the cylinder 06; 07, also has bearing components 32; 33, which are configured to allow the radial movement of the cylinder 06; 07, for adjustment to the print-on or print-off position. To this end, the bearing unit 14 has bearing elements 32 that are stationary on the support, and which are also stationary on the frame following installation of the bearing unit 14, along with the bearing elements 33 that can be moved in relation to the support. The bearing elements 32 that are fixed to the support and 33 that are movable are configured as interacting linear elements 32; 33, and are configured, combined with corresponding sliding surfaces or roller elements between said surfaces, as linear bearings 29. The interacting linear elements 32; 33, in pairs, accommodate a bearing block 34, such as a sliding frame, which, for example tracks between them, and which bearing block 34 accommodates the radial bearing 31. Bearing block 34 and movable bearing elements 33 can also be configured as a single piece. The bearing elements 32 that are fixed to the support are arranged on a support 37, which will be, or is connected as a unit to the side frame 11; 12. The support 37 is configured, for example, as a mounting plate 37, which has, for example, a recess 38, at least on one drive side, for the feed-through of a shaft 39, such as, for example, the drive shaft 39 of a journal 21; 22, which is not shown in FIG. 7, of a cylinder 06; 07. The frame wall 11; 12 also preferably has a recess or an opening for a drive shaft 39 on the drive side. On the side frame end surface that is opposite the drive side, it is not necessary to provide a recess 38 or an opening in the side frame 11; 12.

Preferably, one length of the linear bearing 29, especially at least one length of the bearing element 32 of the linear bearing 29 which, when mounted, is fixed to the frame, and when viewed in the direction of adjustment S, as seen in FIG. 7, is smaller than a diameter of the allocated printing couple cylinder 06; 07.

The coupling of the cylinder 06; 07 or of the bearing block 34 on a drive side of the printing unit 01 to a drive, such as, for example, directly to a drive motor and/or to a drive train or to a transmission, is accomplished as illustrated, by way of example, in FIG. 6 via the shaft 39, which shaft 39 encompasses one end of the journal 21; 22 at its end closest to the cylinder and is connected without torsion, for example via a clamping device 24, to the journal 21; 22. In this case, the clamping device 24 is configured, by way of example as a partially slotted hollow shaft end, which encompasses the journal end of journal 21; 22, these being drawn together by a screw connection in such a way that a non-positive, non-rotatable connection between the journal end of journal 21; 22 and the inner surface of the hollow shaft can be created. The coupling can also be implemented in a different way, for example by using a form closure in a circumferential direction. The shaft 39 is guided through an opening in the side frame 11; 12, which opening is sufficiently large, in dimension, to allow the movement of the shaft 39 together with the bearing block 34, and which opening is configured, for example, in the manner of an elongated hole. A cover 28 with a collar that covers the elongated hole, and which is connected, for example, to the bearing block 34 but not to the shaft 39, can be provided as protection against contamination.

At an end of the shaft 39, that is remote from the cylinder, as illustrated in FIG. 6, one coupling 40 of optionally a plurality of disks arranged in series, especially a multi-disk coupling 40, can be coupled by the use of a non-rotatable connection 36, for example a clamping element 36. In another embodiment, which is not specifically shown here, a drive motor or a transmission with a drive motor can be coupled directly to the shaft 39 without a coupling that is configured to compensate for angle and/or offset as is coupling 40. In this embodiment, the drive motor is not fixed to the frame, for example. Rather, it is arranged fixed to the cylinder and is moved along with the cylinder 06; 07.

The configuration of the linear bearing 29 such that the coordinating bearing elements 32; 33 are both provided on the bearing unit 14 component, and not on a part on the side frame 11; 12 of the printing unit 01, enables a preassembly and a prealignment or an adjustment of the bearing tension. The advantageous arrangement of the two linear bearings 29 that encompass the bearing block 34 enables an adjustment that is free from play. This is because the two linear bearings 29 are arranged opposite one another in such a way that the bearing pre-tension and the bearing forces encounter or accommodate a significant component in a direction that is perpendicular to the rotational axis of the cylinder 06; 07. The linear bearings 29 can thus be adjusted in the same direction that determines the play-free adjustment of the cylinders 06; 07.

Figure 15:
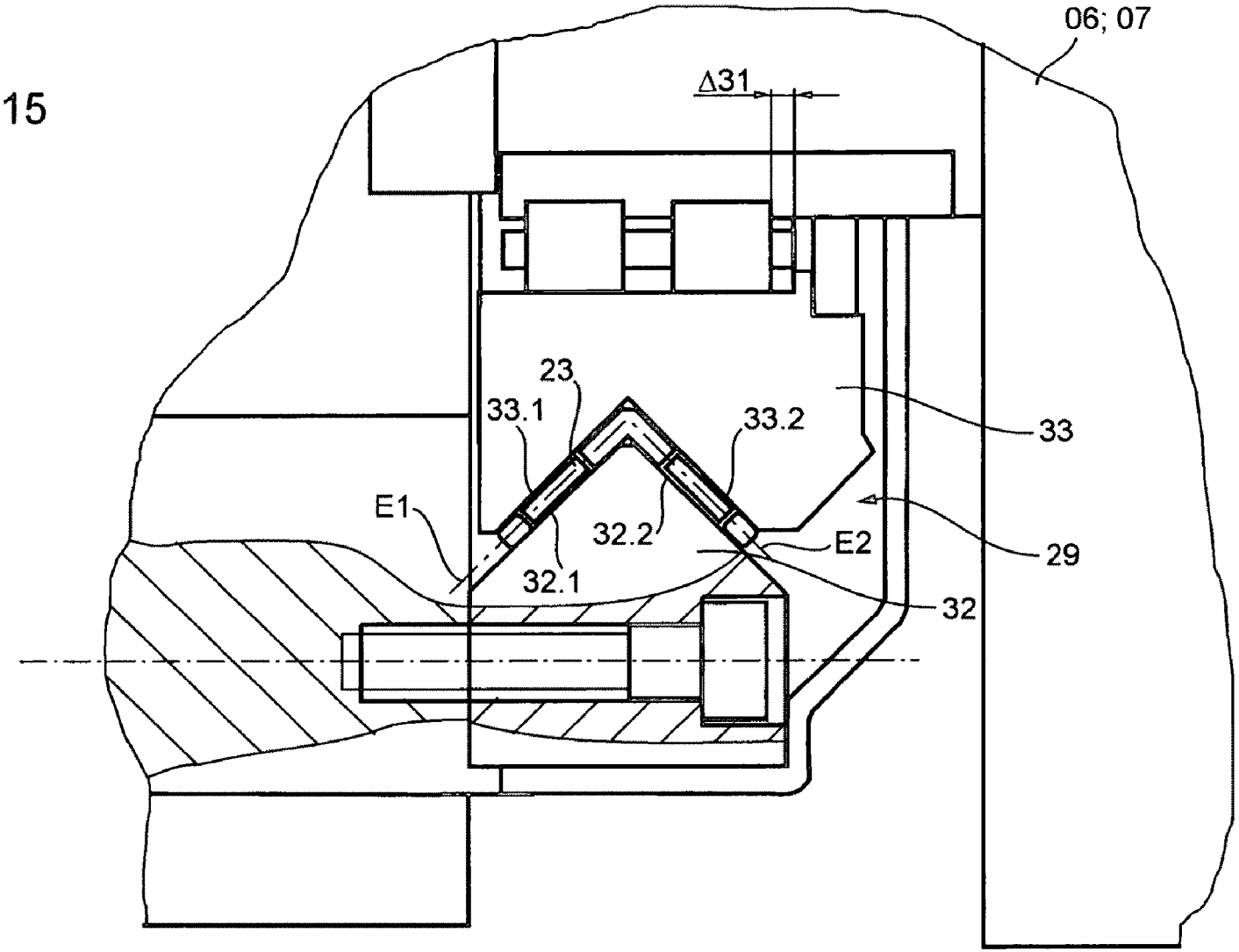
FIG. 15 an enlarged representation of the linear bearing of the type shown in FIG. 6.

The linear bearings 29 and consisting of components 32, 33, and which are identifiable in FIGS. 6 and 7 thus each have pairs of corresponding, coordinating bearing elements 32 and 33 or their guide or active surfaces, configured as sliding surfaces, not shown, or with rolling elements 23 that are arranged between them. As shown in FIG. 15, in the preferred embodiment of the present invention, at least one of the two, and advantageously both of the linear bearings 29 of a bearing unit 14 are structured such that the two corresponding bearing elements 32 and 33 each have at least two guide surfaces 32.1; 32.2; 33.1; 33.2, which lie in two planes that are inclined in relation to one another. The two guide surfaces 32.1; 32.2; 33.1; 33.2, or their planes E1; E2, of the same bearing element 32; 33 are, for example, v-shaped in relation to one another. For example, they are inclined at an angle of between 30° and 60° relative to one another, and especially between 40° and 50°. The two guide surfaces 33.1; 33.2; 32.1; 32.2 of the coordinating bearing element 33; 32 are inclined relative to one another in a manner that complements their shape. At least one of the two pairs of coordinating guide surfaces 32.1; 32.2; 33.1; 33.2 lies parallel to a plane E1, which has a component, that is not equal to zero, in the radial direction of the cylindrical axis, and thereby suppresses the degree of freedom of movement of the cylinder 06; 07 in a purely axial direction. Preferably both pairs of the guide surfaces lie in the planes E1; E2, each of which planes has a component that is not equal to zero in the radial direction of the cylindrical axis, but is against the cylindrical axis in the reverse inclination. Therefore, they suppress the degree of freedom of movement in both axial directions of the cylinder 06; 07. A line of intersection of the two planes E1; E2 extends parallel to the direction of adjustment S.

If, as is apparent in FIG. 6, the bearing block 34 is bordered between the two linear bearings 29, each of which linear bearings 29 has two pairs of coordinating guide surfaces 32.1; 33.1 and 32.2; 33.2, and especially if it is prestressed with a level of pre-tension, then the bearing block 34 has only a single degree of freedom of movement along the direction of adjustment S.

The inclined active or guide surfaces 32.1; 32.2; 33.1; 33.2 are arranged such that they counteract a relative movement of the bearing parts of the linear bearing 29 in an axial direction of the cylinder 06; 07. In other words the bearing is "set" in an axial direction.

The linear bearings 29 of both of the bearing units 14, which are allocated at the end surfaces of a cylinder 06; 07 preferably have two pairs of coordinating guide surfaces 32.1; 32.2; 33.1; 33.2 arranged in this manner in relation to one another. In this case, however, at least one of the two radial bearings 31 of the two bearing units 14 advantageously has a slight bearing clearance A31 in an axial direction.

In FIG. 6 and in FIG. 15, the guide surfaces 32.1; 32.2 of the bearing elements 32 that are fixed to the frame, point the linear guide 29 in the half-space that faces the journal 21; 22. In this case, the bearing elements 32 that are fixed to the frame encompass the bearing block 34, which is arranged between them. The guide surfaces 32.1; 32.2 of the two linear bearings 29, which are fixed to the frame, thus wrap partially around the guide surfaces 33.1; 33.2 of the bearing block 34, relative to an axial direction of the cylinder 06; 07.

For the correct placement of the bearing units 14 or of the cylinder units 17 and including the bearing unit 14, respectively, mounting aids 51, such as alignment pins 51, can be provided in the side frame 11; 12 on which the bearing unit 14 of the fully assembled cylinder unit 17 is aligned, before being connected to the side frame 11; 12 via separable connecting elements 53, such as screws 53, or even with adhesive force via welding. For the adjustment of the bearing pre-stress in the linear bearings 29, which adjustment is to be performed prior to installation of the fully assembled cylinder unit 17 in the printing unit 01 and/or to be readjusted after installation, appropriate assemblies 54, such as, for example, adjustment screws 54, can be provided, as seen in FIG. 6. The bearing unit 14, at least toward the cylinder side, is preferably largely protected against contamination by a cover 57, or is even configured as a completely encapsulated structural unit.

In FIG. 6 the cylinder 06; 07 is schematically illustrated with journals 21; 22 and with a preassembled bearing unit 14. This component group can therefore be easily installed, preassembled, between the side frames 11; 12 of the printing unit 01, and can be fastened at points which are designated specifically for this purpose. Preferably, for a modular construction, the bearing units 14 for the forme and transfer cylinders 07; 06, if applicable up to the permitted functional extent of the adjustment path, are similarly constructed. With the preassembled embodiment, the effective inner surface of the radial bearing 31 and the effective outer circumferential surface of the journal 21; 22 can be cylindrical rather than conical in structure, as both the mounting of the bearing unit 14 on the journal 21; 22 and the adjustment of the bearing clearance can take place outside of the printing unit 01. For example, the bearing unit 14 can be narrowed to fit.

The structural unit that can be mounted as a complete unit, typically, the bearing unit 14 is advantageously configured in the manner of an optionally partially open housing comprising, for example, the support 37, and/or, for example, a frame. As may be seen in FIG. 7, for example, the frame includes the four side supports 92; 93; 94; 96, such as, for example, side plates 92; 93; 94; 96, that border the bearing unit 14 toward the outside on all four sides and/or, for example, the cover 57, as is shown in FIG. 6. The bearing block 34 having the radial bearing 31, the linear guides 29, and, in one advantageous embodiment, for example, the actuator 43 or the actuators 43 are accommodated inside this housing or this frame.

The bearing elements 32 that are fixed to the frame are arranged essentially parallel to one another and define a direction of adjustment, as shown in FIG. 7.

An adjustment of the cylinder pair to a print-on position is accomplished by moving the bearing block 34 in the direction of the printing point by the application of a force F that is applied to the bearing block 34 by at least one actuator 43, and especially by an actuator 43 that is power-controlled or that is defined by a force, and which can apply a defined or a definable force F to the bearing block 34 in the print-on direction to accomplish adjustment to the on position, all as seen in FIG. 7. The linear force $F_L$ at the nip points 15, which linear force is decisive for ink transfer and thus for print quality is thus defined, among other factors, not by an adjustment path, but by the equilibrium of forces between the force F and the linear force $F_L$ that results between the cylinders 06; 07, and the resulting equilibrium. In a first embodiment of the present invention, which is not shown separately, cylinders 06; 07 are engaged against one another in pairs, in that the bearing block 34 is acted upon by the correspondingly adjusted force F via the actuator or actuators 43. If a plurality of cylinders 06; 07, such as, for example, three or four such cylinders that are adjacent to one another in direct sequence, and which act in coordinating pairs, are implemented without a possibility for fixing or for limiting the adjustment path S using a purely force-based adjustment mechanism, then, although a system that has already been adjusted with respect to the necessary pressures or linear forces can again be properly adjusted in sequence and in succession, it is difficult to implement a basic setting adjustment, due to the somewhat overlapping reactions.

To adjust the basic setting of a system, with corresponding packings and the like, it is thus provided, in one advantageous embodiment of the present invention, that at least the two center cylinders of the four cylinders 06, or in other words, at least all the cylinders 06 that differ from the two outer cylinders 07, can be fixed or at least can be limited in their travel, at least during a period of adjustment to a defined position, and advantageously to the position of engagement which is determined by the equilibrium of forces.

Particularly advantageous is an embodiment of the present invention in which the bearing block 34, even during operation, is mounted such that it can move in at least one direction away from the printing point against a force, such as, for example, against a spring force, and especially against a definable force.

With this, in contrast to mere travel limitation, on one hand a maximum linear force is defined by the coordination of the cylinders 06; 07, and on the other hand a yielding capability is enabled, for example in the case of a web tear which may be associated with a paper jam on the cylinder 06; 07.

On its one side that faces the printing point 05, the bearing unit 14 has a movable stop 41, which movable stop 41 limits the adjustment path up to the printing point 05, at least during the adjustment process. The position of the movable stop 41 can be moved such that a stop surface 44 of the movable stop, and that acts as the stop, can be varied in at least one area along the direction of adjustment. Thus, in one advantageous embodiment of the present invention, an adjustment device, or an adjustable stop 41 is provided, by the use of which, the location of an end position of the bearing block 34 that is near the printing point can be adjusted. For travel limitation/adjustment, for example, a wedge drive, as will be more fully described below, is provided. In principle, the stop 41 can be adjusted manually or via an adjustment element 46 which is implemented as an actuator 46, as will be discussed below. Further, in one advantageous embodiment, a holding or clamping element, which is not specifically illustrated in FIGS. 6 and 7, is provided, by the use of which holding or clamping element, the stop 41 can be secured in the desired position. Further, at least one spring-force element 42, such as, for example, a spring element 42, is provided, which exerts a force $F_R$ from the stop 41 against the bearing block 34 in a direction away from the stop. In other words, the spring element 42 effects an adjustment of the bearing block 34 to the print-off position, when the movement of the bearing block 34 is not impeded in some other way. An adjustment of the bearing block 34 to the print-on position is accomplished by moving the bearing block 34 in the direction of the stop 41 via at least one actuator 43, and especially via a power-controlled actuator 43, by the use of which actuator 43 a defined or a definable force F can optionally be applied to the bearing block 34 in the print-on direction for the purpose of adjustment. If this force F is greater than the restoring force $F_R$ of the spring elements 42, then, with a corresponding spatial configuration, an adjustment of the cylinder 06; 07 in relation to the adjacent cylinders 06; 07 and/or an adjustment of the bearing block 34 in relation to the stop 41 takes place.

In an ideal case, the applied force F, the restoring force $F_R$ and the position of the stop 41 are selected such that between the stop 41 and the stop surface of the bearing block 34, in the engagement position, no substantial force AF is transferred, and such that, for example, $|_{\Delta}F|<0.1*(F-F_R)$, especially $|_{\Delta}F|<0.05*(F-F_R)$, ideally $|_{\Delta}F|\approx 0$ applies. In this case, the adjustment force between the cylinders 06; 07 is essentially determined from the force F that is applied via the actuator 43. The linear force at the nip points, which is decisive for ink transfer and thereby for print quality, is thus defined, among other factors, primarily not by an adjustment path, but, in the case of a quasi-free stop 41, by the force F and by the resulting equilibrium. In principle, once the basic adjustment has been determined with the forces F necessary for this, a removal of the stop 41 or of a corresponding immobilization element, that is effective only during the basic adjustment, would be conceivable.

In principle, the actuator 43 can be configured as any actuator 43 that will exert a defined force F. Advantageously, the actuator 43 is configured as a pneumatically actuatable correcting element 43, and especially as pistons 43 that can be moved by a fluid. Advantageously, with respect to a possible tilting, the arrangement involves a plurality of actuators 43 of this type, in this case, as depicted in FIG. 7 two such actuators 43. A liquid, such as oil or water, is preferably used as the actuator fluid due to its incompressibility. In another embodiment, the actuator 43 can also be configured as a piezo actuator, with a piezoelectric force application or as a magnet, with a magnetic force application, and especially as an electromagnet.

To actuate the actuators 43, which are configured, in this case, as hydraulic pistons 43, a controllable valve 56 is provide either inside or outside of the bearing unit 14, again as may be seen in FIG. 7. Valve 56 is configured, for example, to be electronically actuatable, and places the hydraulic pistons 43 in one position that is pressureless or at least is at a low pressure level. In another position of the controllable valve 56, the pressure P that conditions the force F is present. In addition, for safety purposes, a leakage line, which is not specifically shown here, is also provided.

In order to prevent on/off adjustment paths that are too long, while still protecting against web wrap-up, on the side of the bearing block 34 that is distant from the printing points, a travel limitation by the provision of a movable, force-limited stop 49 as an overload protection element 49, such as, for example, a spring element 49, can be provided. This force-limited stop or overload protection element 49 in the operational print-off position, wherein the pistons 43 are disengaged and/or drawn in, can serve as a stop 49 for the bearing block 34 in the print-off position. In the case of a web wrap-up, or of other excessive force from the printing point 05, stop 49 will yield and will open up a larger path. A spring force for this overload protection element 49 is therefore selected to be greater than the sum of forces from the spring elements 42. Thus in operational on/off adjustment, a very short adjustment path, for example only 1 to 3 mm, can be provided.

In the represented embodiment, as seen in FIG. 7, the stop 41 is implemented as a wedge 41 that can be moved crosswise to the direction of adjustment S. In the movement of wedge 41, the position of the respective effective stop surface 44, along the direction of adjustment S, varies. The wedge 41 is supported, for example, against a stop 58 that is stationarily fixed to the support. The stop 58, which is fixed to the support, is formed, in this case, for example, by a side support 92 for the bearing unit 14.

The stop 41, which is implemented here as a wedge 41, as seen in FIG. 7, can be moved by an actuator 46, such as, for example, by a pneumatically actuatable connecting element 46, such as a pneumatically actuatable piston 46, in an actuator cylinder with dual-action pistons, via a transfer element 47 that may be configured, for example, as a piston rod 47, or by an electric motor via a transfer element 47 which may be configured as a threaded spindle. This actuator 46 can either be active in both directions or, as shown here, may be configured as a one-way actuator, which, when activated, works against the force of a restoring spring 48. For the aforementioned reasons, largely powerless stop 41 the force of the restoring spring 48 is selected to be weak enough that the wedge 41 is held in its correct position against only the force of gravity or vibration forces.

In principle, the stop 41 can also be implemented differently, such as, for example, as a ram that can be adjusted and which can be affixed in the direction of adjustment, or the like, such that it forms a stop surface 44 for the movement of the bearing block 34 in the direction of the printing point 05, which is variable in the direction of adjustment S and which, at least during the adjustment process, can be fixed in place. In an embodiment which is not specifically illustrated here, an adjustment of the stop 41 is implemented, for example, directly parallel to the direction of adjustment S via a drive element, such as, for example, via a pneumatically actuatable cylinder, with typically dual-action pistons or an electric motor.

Figure 8:
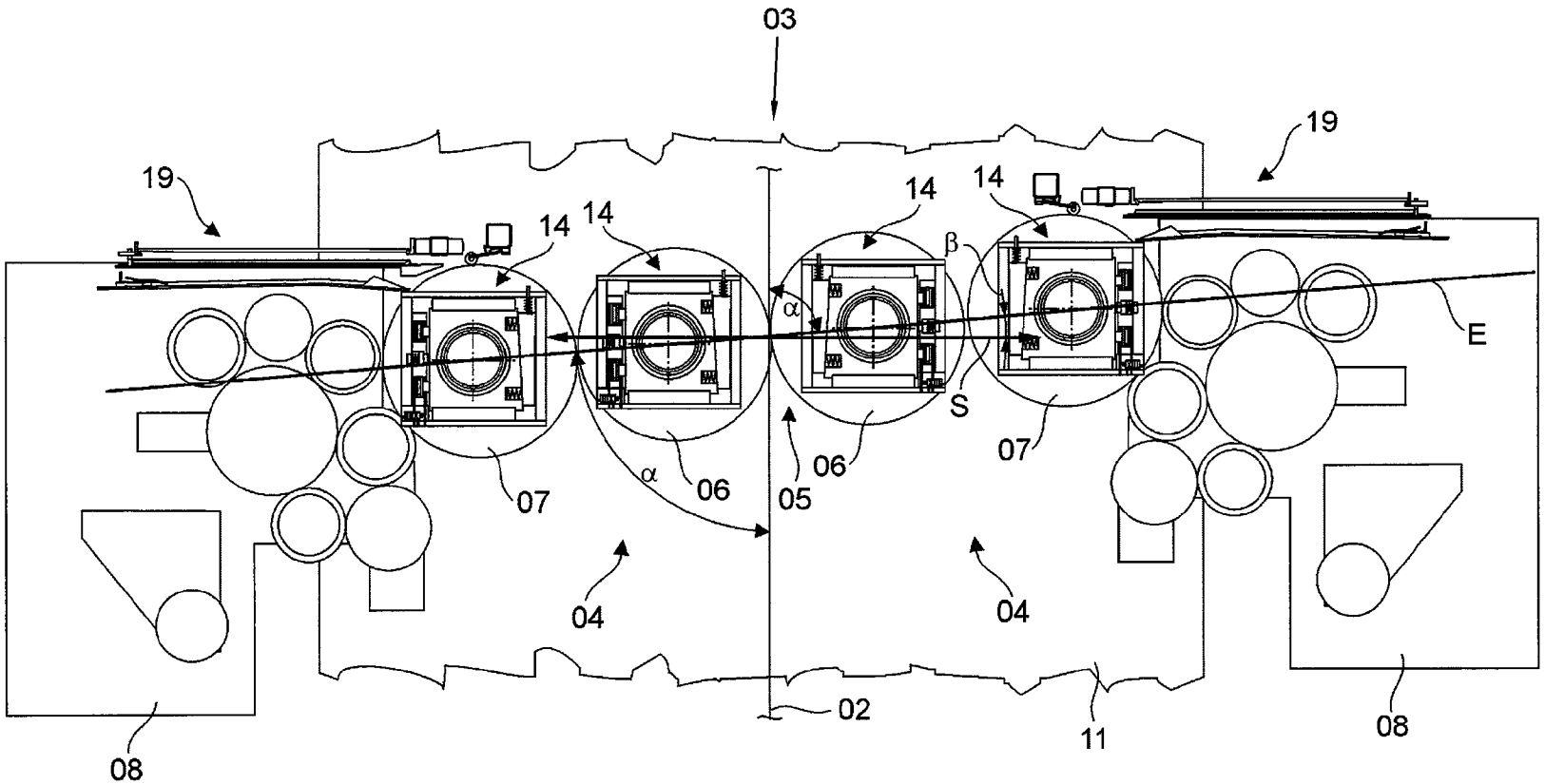
FIG. 8 a first embodiment of a bearing arrangement for a blanket-to-blanket printing couple.

FIG. 8 schematically shows, on a printing couple 03 which is configured as a blanket-to-blanket printing couple 03, one bearing unit 14, arranged on the side frame 11, for each cylinder 06; 07. In an advantageous embodiment, as is illustrated here, in the print-on position, the rotational centers of the cylinders 06; 07 form an imaginary line or a plane of connection E, which is hereinafter referred to as a "linear blanket-to-blanket printing couple". The plane E and the entering and exiting web 02 preferably form an interior angle $\propto$ that deviates from 52°, measuring between 36 and 49°, especially between 80 and 48°. In the mounted state of the embodiment which is depicted in FIG. 8, the bearing unit 14 of the transfer cylinder 06, and especially of all cylinders 06; 07, are arranged on the side frame 11 in such a way that their directions of adjustment S, for example for the purpose of a power-defined print-on adjustment, as will be discussed below form a maximum angle of 15° with the plane of connection E, for example an acute angle β of approximately 2° to 15°, especially 4 to 10°, with one another. This arrangement is of particular advantage, with respect to assembly, if the direction of adjustment S extends horizontally and the web 02 extends essentially vertically.

In a modified embodiment, as is depicted in FIG. 1 of a blanket-to-blanket printing couple 03 arranged in an angular fashion, and as an "_n_" or "_u_": printing couple 03, the plane E' is understood as the plane of connection for the cylinders 06 that form the printing points 05, and the plane E" is understood as the plane of connection between the forme and transfer cylinders 07; 06, and what is described above in reference to the angle β is referred to the direction of adjustment S for at least one of the cylinders 06 that form the printing points 05, or the forme cylinders 07, and the planes E' or E".

One of the cylinders 06 that form the printing points 05 can also be arranged in the side frame 11; 12 such that it is stationary and functionally non-adjustable, but optionally could be adjustable, while the other cylinder 06 of the respective printing point 05 is mounted such that it is movable along the direction of adjustment S.

A functional adjustment path, for adjustment to the on/off positions along the direction of adjustment S between the print-off and print-on positions, in the case of the transfer cylinder 06, measures, for example, between 0.5 and 3 mm, and especially between 0.5 and 1.5 mm, and in the case of the forme cylinder 07 measures between 1 and 5 mm, and especially between 1 and 3 mm.

In an embodiment, as a linear blanket-to-blanket printing unit 03, the plane E is inclined from the planes of the incoming and outgoing web 02 for example, at an angle $\alpha$ of a 80 to 86° on the respective other side of the web.

Figure 9:
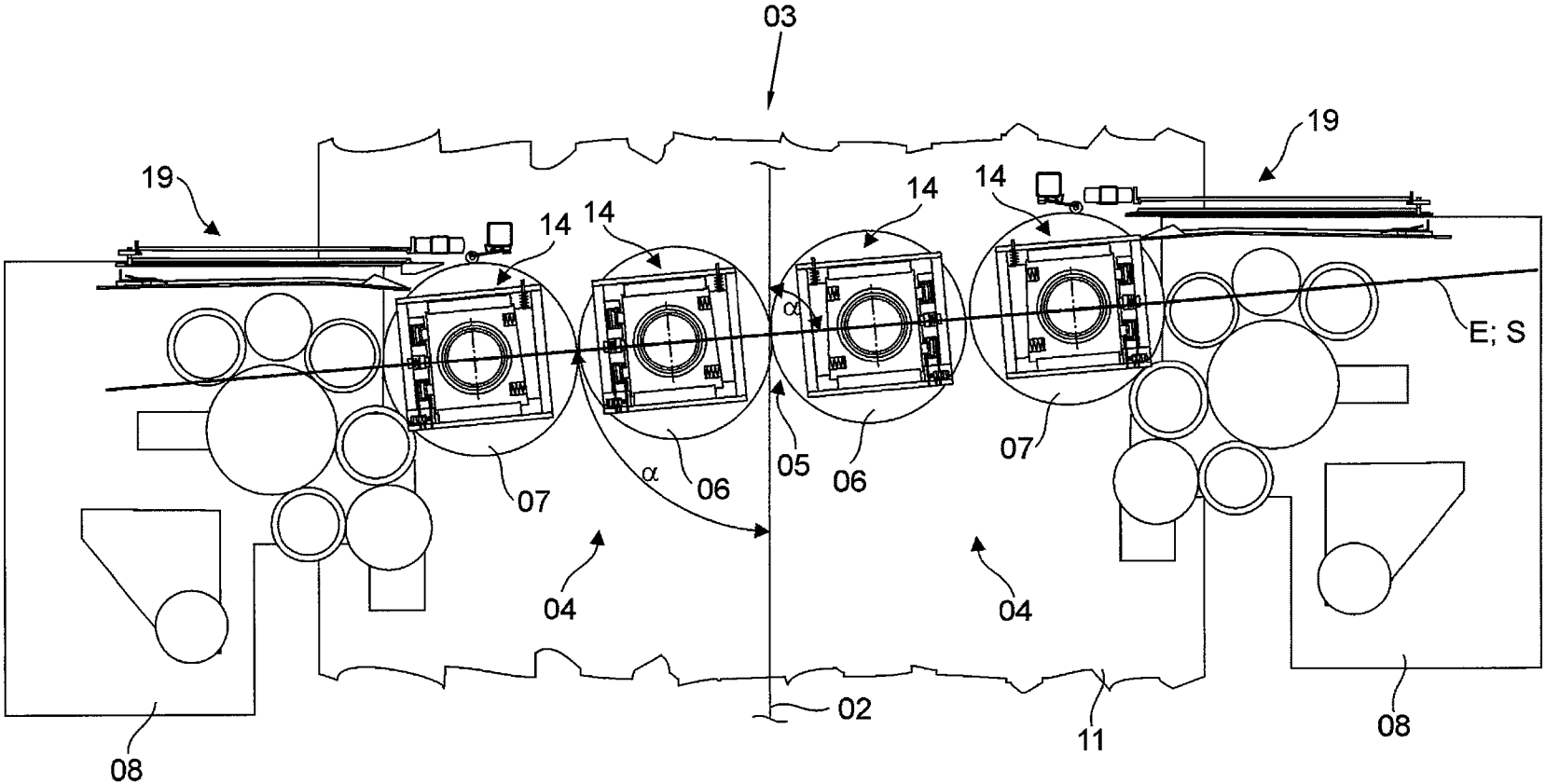
FIG. 9 a second embodiment of a bearing arrangement for a blanket-to-blanket printing couple.

In another embodiment, which is illustrated in FIG. 9, the bearing units 14 of the transfer cylinder 06, and especially of all of the cylinders 06; 07, are arranged in the mounted state on the side frame 11 in such a way that their directions of adjustment S coincide with the plane of connection E, in other words they form an acute angle $\beta$ of approximately 0°. Thus, all of the directions of adjustment S coincide, and are not spaced from one another.

Figure 10:
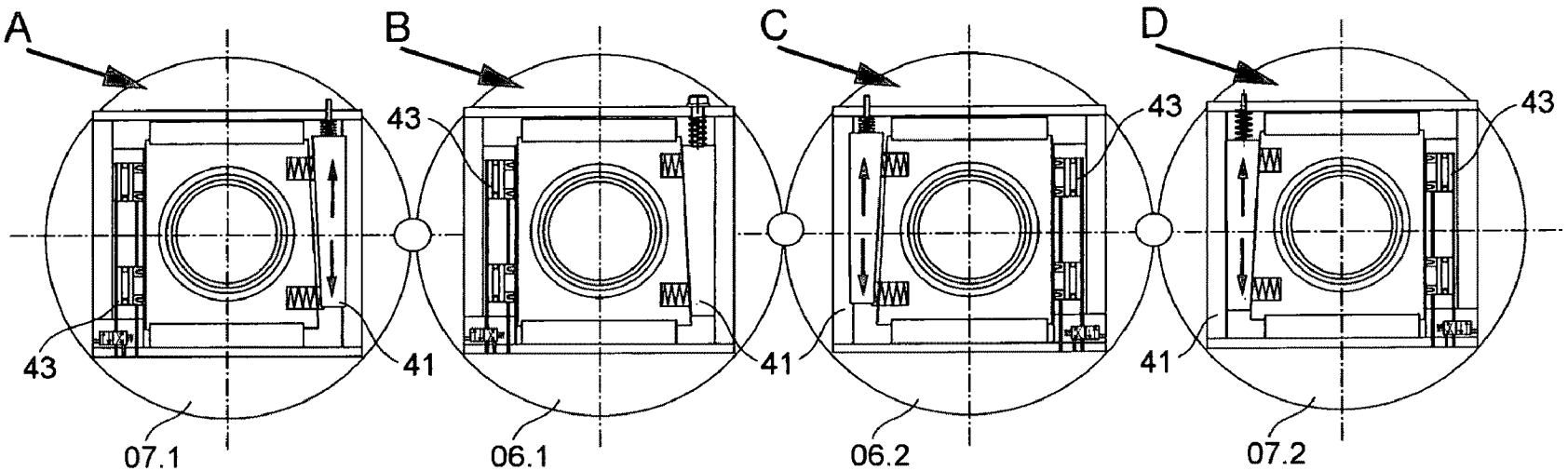
FIG. 10 a schematic depiction showing the basic principle of the mounting and adjustment of the cylinders in accordance with the present invention.

Independent of the inclination of the adjustment paths, in relation to the plane E or E' or E", either with slight inclination or with no inclination, as shown in FIGS. 8 and 9, in the context of the schematic example of FIG. 10 an advantageous process method for adjusting the cylinders 06; 07, which, in this case are given the suffixes "1" and "2" to differentiate between the left and right printing couples or their print-on position is described in what follows:

First, a first cylinder 06.1 that participates in defining the printing point 05, such as, for example, a transfer cylinder 06.1, is aligned in its position in the print-on setting, wherein its actuators 43 are active within the printing unit 01 and relative to the web 02 by adjusting the stops 41 at both end surfaces. This can be accomplished, as indicated here, by the use of an actuator 46, such as an adjustment screw, which is shown here, by way of example, as being manually actuatable. A so-called "0-position" that defines the printing point is hereby established.

Once the stop 41 of the assigned forme cylinder 07.1 has been released, or in other words, once the stop 41 has been removed, for example, in advance by drawing it toward the top, and when the print-on position of the transfer cylinder 06.1 is still activated, in other words actuators 43 of the transfer cylinder 06.1 are activated, the amount of force F desired between the forme and transfer cylinders 07.1; 06.1 for the print-on position is exerted. Here, this is accomplished by an impingement of the actuators 43 of the forme cylinder 07.1 with the desired amount of engagement pressure P. If the bearing unit 14 of the first forme cylinder 07.1 is also equipped with an adjustable stop 41, then in a first variation, this stop 41 can now be placed, essentially without force, into contact with the corresponding stop surface of the bearing block 34 on the first forme cylinder 07.1.

When the print-on position is activated, or in other words when force is respectively exerted in the direction of the printing point 05 for the two first cylinders 06.1; 07.1, and the print-off position of the second forme cylinder 07.2 is activated, while the stop 41 of the third cylinder 06.2 is being released, or after it has been released, the desired amount of force, or pressure P for the print-on position is exerted on the second transfer cylinder 06.2 or on its bearing block 34, and once equilibrium is reached, its stop 41 is placed, essentially without force, in contact with the corresponding stop surface of the bearing block 34. Within this framework, the stop 41 of the first forme cylinder 07.1 can also be placed in contact with the assigned bearing block 34 before, during, or afterward, if this has not already taken place as in the above-described variation.

In a final step, with a free or an already released stop 41, the second forme cylinder 07.2, or its bearing block 34 is placed in the print-on position, while the assigned transfer cylinder 06.2 is also in print-on. Once a steady-state condition is reached, if a stop 41 is provided there, this stop 41 is also placed, essentially without force, in contact with the corresponding stop surface of the bearing block 34 on the second forme cylinder 07.2.

In this manner, an adjustment of the cylinders 06; 07 of the blanket-to-blanket printing couple 03, that is optimal for the printing process, is accomplished.

Figure 11:
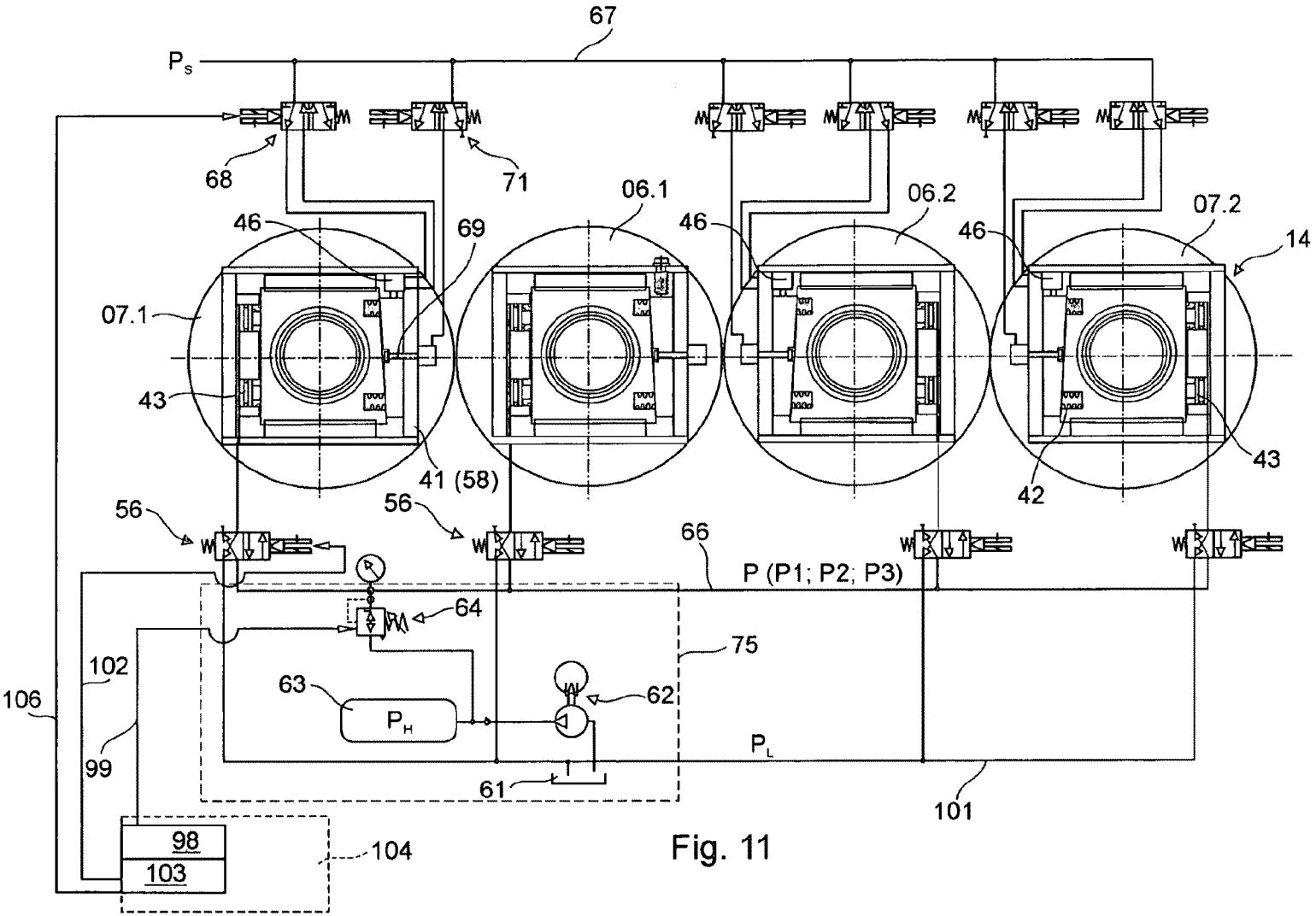
FIG. 11 a preferred embodiment of an interconnection of a pressure medium supply arrangement.

In FIG. 11, a preferred embodiment of an interconnection of a pressure medium supply arrangement, which is suitable for use in implementing the aforementioned process method, is shown. A fluid reservoir 61 that is either open or closed toward the outside is set at a pressure level for a pressure $P_L$, such as, for example, ambient pressure that is lower than a pressure that corresponds to the restoring force $F_R$ of the spring elements 42 of a bearing unit 14. The pressure medium or fluid is compressed by a compressor 62, such as, for example, by a pump or by a turbine, to a pressure level $P_H$ or to a pressure $P_H$, which corresponds at least to the pressure level P or the pressure P that is required for the contact force F. In order to minimize pressure fluctuations, which may be caused by the removal of pressure medium, fluid compressed to the pressure $P_H$ can be advantageously stored in a pressurized tank 63. From the pressure medium line that contains the high pressure level $P_H$, a supply line 66 is pressurized via a control element 64, and especially via an adjustable pressure-reducing control element 64. The pressure level P of that supply line 66 is adjusted, via the pressure-reducing element 64, to the preselected pressure level P or to the pressure P that is suitable for adjustment to the print-on position with a corresponding force F; if applicable taking into account the restoring force $F_R$ and optionally the force $\Delta F$.

In FIG. 11, dashed lines indicate the combination of units which are required for pressure medium supply, which combination of units include fluid reservoir 61, compressor 62, pressurized storage tank 63 and adjustable pressure-reducing valve 64, all of which cooperate to form a supply system 75. In this case the valves 56 are arranged close to the cylinder, outside of the supply system 75. However, they could also be centrally integrated into the supply system. The fluid reservoir 61 could also be arranged outside of the supply system 75 so as to be centrally available for a plurality of supply systems 75.

The pressure-reducing valve 64 can be adjusted via an adjustment device 98, and especially via a control device 98. Preferably, adjustment of the pressure-reducing valve 64 is remotely implemented by the control device 98 via a signal line 99. In FIG. 11, in addition to the pressure level identified as P, three pressures P1, P2 and P3 of different levels, or three pressure levels P1, P2 and P3, are referenced in parentheses and can optionally be provided in one advantageous embodiment, via the appropriate control of the pressure-reducing valve 64, in the supply line 66. These pressure levels P1, P2 and P3 correspond to different force levels for the print-on position. In this context please see the further improvement which will be described in what follows.

In one advantageous embodiment that is not specifically shown here, two different pressure levels P, such as, for example, $P_{DS}$ for the contact force at the printing point, and $P_{DW}$ for the contact force between the printing couple cylinders 06; 07 can also be provided via two adjustable, and especially remotely adjustable, pressure-reducing elements 64 in two supply lines 66. In an advantageous embodiment, however, during the adjustment process, the pressure level $P_{DS}$ for the contact force at the printing point 05, and the pressure level $P_{DW}$ for the contact force between the printing couple cylinders 06; 07 can be alternatingly supplied in a supply line 66. In this case, during the adjustment process, for example, first the pressure level $P_{DS}$ for the contact force at the printing point 05 is supplied via the pressure-reducing valve, and is selected via the control device 98 or via the machine control system, and the transfer cylinder 06 is engaged accordingly. Afterward, the pressure level $P_{DW}$ for the contact force between the forme and transfer cylinders 06; 07 is supplied, and the adjustment of the forme cylinder 07 is implemented. For the case, which will be described below, in which different pressure levels P1, P2, P3, or in other words, the resulting force levels are provided for the adjustment of the cylinders 06; 07 based upon certain machine data and/or on certain consumable product data and/or on certain operational data, one of multiple, such as, for example, three, different pressure levels, for example, is selected for the adjustment of the transfer cylinder 07, after which, the forme cylinder 07 is adjusted with a single pressure level, or even with one of possible pressure levels $P_{DW4}$, $P_{DW5}$, $P_{DW6}$. This variation offers a very high level of adjustment to the conditions that are optimal for the printing process. What is described below regarding the provision of the various corresponding default values, in the context of the example of P1, P2 and P3, can be transferred to applications involving different handling of the transfer cylinder 06 and forme cylinder 07. In this case, for the level that is relevant to the transfer cylinder 06, a series of default values can then be provided and stored, whereas for the level relevant to the forme cylinder 07, one or more of its own default values can be stored. The pressure-reducing valves 64 are then acted upon in succession by the selected default value for the pressure level $P_{DS}$, from, for example, $P_{DS1}$, $P_{DS2}$, $P_{DS3}$, for example based upon the type of paper and then, by the selected default value for the pressure level $P_{DW}$, from, for example, $P_{DW4}$, $P_{DW5}$, $P_{DW6}$, for example based upon the type of blanket. In this regard, please see FIG. 23).

The intakes of the valves 56, and especially of multiway valves, which have already been described in reference to FIG. 7, for each adjustable cylinder 06; 07, are then connected to the supply line 66 for the pressure P or P1, P2, P3. With the two aforementioned levels for the forme and transfer cylinders 06; 07, the intakes of the valves 56, which are allocated to the movable transfer cylinders 06, are connected to the pressure $P_{DS}$ and the intakes for the valves 56, which are allocated to the forme cylinders 07, are connected to the pressure $P_{DW}$, for example. The outlets of the valves 56 are connected to the fluid reservoir 61, for example, via a shared reflux line 101. The valves 56 can be adjusted via a control unit 103, such as, for example, a shared control unit that encompasses the two control units 98 and 103. Adjustment is preferably remotely implemented by the control device 103 via a signal line 102.

The control device 98 and/or 103 can be housed, for example, as a program routine, in a control center 104 or in a control center computer 104, which is schematically indicated by a dashed line in FIG. 11 for use in controlling the printing press. For example, when a "print-on" command is issued through a program routine or manually via an input or a switch, the valves 56 for the relevant cylinders 06; 07 or for the printing couples 04 are switched by the control unit 103 such that the actuators 43 are connected to the pressure P in the supply line. With the "print-off" command, the valves 56 are switched, for example, such that the actuators 43 are connected to the pressure level $P_L$ in the reservoir.

An adjustment of the stops 41, which are configured to be movable not solely manually, via the correcting elements 46, which may be configured as pneumatically operated actuators 46, is accomplished, for example, advantageously either via a separate supply line 67 that supplies a pressure $P_S$, as shown or optionally integrated into the aforementioned pressure level P or P1, P2, P3. As shown in FIG. 11, the fluid that supplies the pressure $P_S$ as a gaseous pressure medium, such as compressed air, may be provided in an open system. An intake of a valve 68 that is connected to the assigned actuator 46 is connected to the supply line 67, wherein, depending upon the embodiment of the actuator 46, either dual-action in both directions, or active in only one of two possible directions, one or two outlets for the valve 68 are connected to one or two intakes for the actuator 46, respectively. The valves 68 can also preferably be controlled via a control device, such as, for example, via the control device 103. In this case as well, adjustment is preferably implemented remotely via a signal line 106 which is allocated to the control device 103.

In a further improvement, as is shown in FIG. 11, an actuatable holding element 69, such as, for example, a ram, for the purpose of fixing the stop 41 in place, is also provided, and with which the stop 41 can be held in its essentially force-free position, without changing its position when released for adjustment to the print-off position. This holding element 69 can also be connected to the pneumatic supply line 67, via corresponding lines and additional valves 71, for the purpose of actuation or release, and can advantageously be adjusted via the control device 103. In the example shown, the holding element 69 is configured to optionally clamp the stop 41, during activation in relation to the bearing block 34, in a non-positive fashion.

Figure 13A:
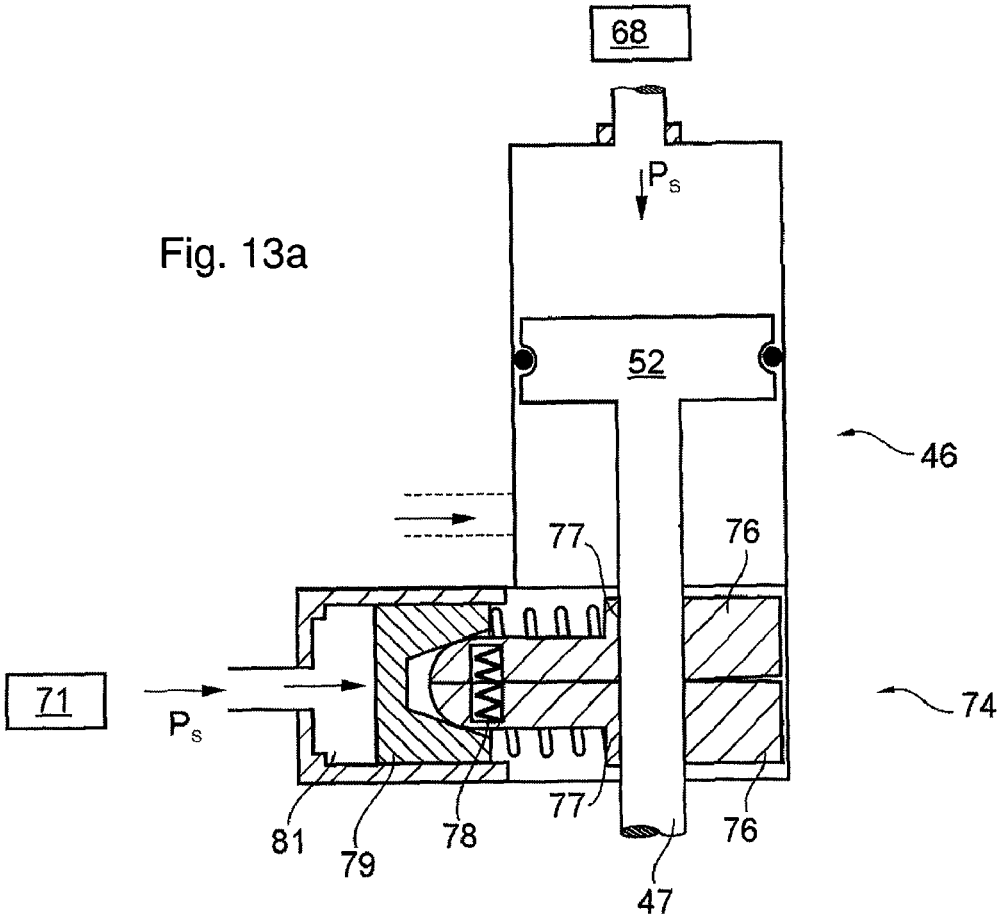
FIG. 13*a* an embodiment of a holding element for a stop on the bearing unit according to FIG. 11 and showing the stop in its released position, FIG. 13*b* an embodiment of a holding element for a stop on the bearing unit according to FIG. 11 and showing the stop in its operating position.
Figure 13B:
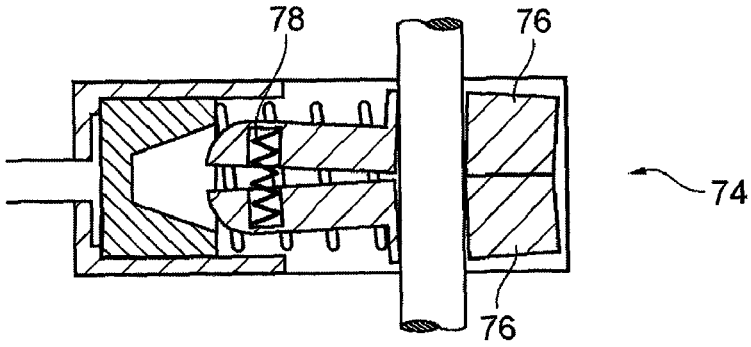

In one advantageous embodiment, in place of the holding element 69 that fixes the stop 41 in place, a holding element 74, as represented in FIG. 13, is provided, with which the transfer element 47, and especially the piston rod 47, or a corresponding extension piece, can be clamped. The holding element 74 can be integrated into the actuator 46, or can be arranged between the actuator 46 and the stop 41 as shown here, in such a way that the transfer element 47 can be optionally held in place or can be freely movable in its direction of motion. For example, the holding element 74 has two clamping jaws 76 with openings 77, or at least with recesses for encompassing the transfer element 47, which clamping jaws 76 are in active connection with the transfer element 47. In a first functional position, in which the longitudinal axes of the openings 77 extend parallel to the transfer element 47, they release the transfer element 47. In a second functional position, in which the longitudinal axes of the openings 77 are tilted relative to the longitudinal axis of the transfer element 47, especially they are spread apart from one another, the transfer element 47 is clamped, preventing motion. The holding element 74 is preferably configured to be self-locking, so that when the holding element 74 is not actuated, such as, for example, via the force of a spring 78, the second functional position is assumed. The clamping jaws 76 are actuated by the surfaces of an actuator 79 that are inclined in such a way that when the actuator 79 is in a first position, the clamping jaws 76 are inclined, and when the actuator 79 is in a second position, they are not inclined. In principle, the holding element 74, and especially the actuator 79, can be actuated manually, for example via a corresponding actuation device, or non-manually, especially remotely, advantageously via a servo drive 81. In FIG. 13, the servo drive 81 is configured as a pneumatically actuatable cylinder 81, in which the actuator 79, which is configured as a piston, is movable. When the actuator 79 it is acted upon by the pressure $P_S$, as seen in FIG. 13 *a*, the clamp is released, in this case by a corresponding orientation of the clamping jaws 76 or their openings 77. With release of the actuator, as depicted in FIG. 13 *b*, a spreading or a tilting of the clamping jaws 76 is accomplished via the spring 78, causing a clamping.

The stop 41 can be reset either by the spring 48 shown in FIG. 7 or alternatively, as indicated in FIG. 13 by a dashed line, actively via the configuration of the actuator 46 as a pneumatically actuatable cylinder with dual-action pistons, or in other words as a cylinder with two pressure medium supply lines, one on each side of a piston 52.

In the representation of the present invention, as shown in FIG. 11, the bearing units 14 of all four cylinders 06; 07 of the blanket-to-blanket printing couple 03 are supplied from a shared pressurized storage tank 63 via a shared supply line 66. All of the bearing units 14 for the cylinders 06; 07 of all of the blanket-to-blanket printing couples 03 in a printing tower 01 can be connected to the supply line 66 via a shared line. In other words, to supply the bearing units 14 of a printing tower 01 with the pressure P, P1, P2, or P3, a supply line 66 is provided, which is connected in series and/or in parallel, as is shown here to the valves 56 of the individual bearing units 14.

Figure 21:
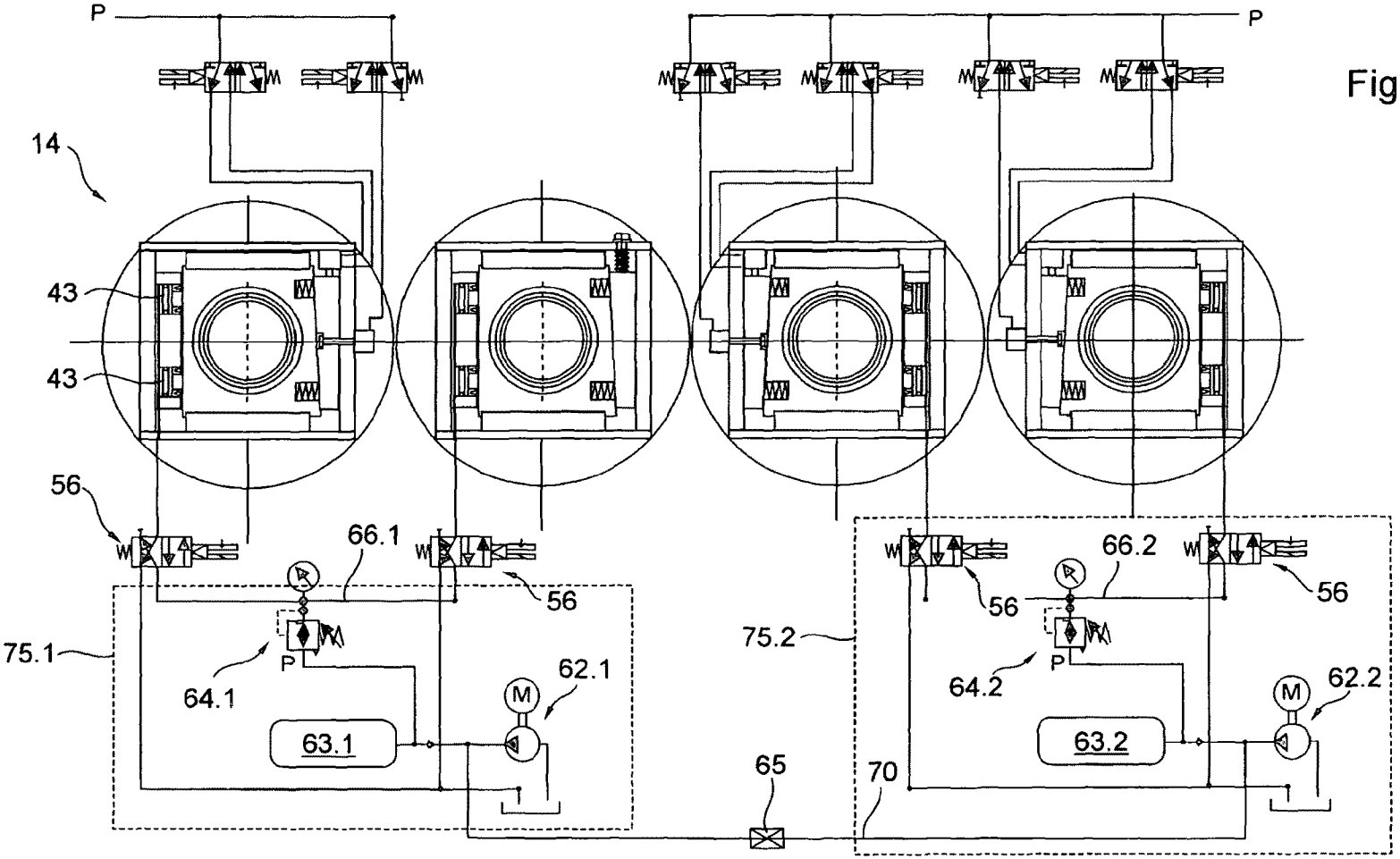
FIG. 21 a second embodiment of an interconnection of a pressure medium supply arrangement in accordance with the present invention.

In a variation, which is shown in FIG. 21, the system for supplying the bearing units 14 of a printing unit 01, and especially of a printing tower 01, with a pressure medium at the adjustable pressure P, P1, P2, or P3 is configured as a multiple, such as, for example, as a dual, system, and especially as a system with separate units for each of the two printing unit sections 01.1; 01.2. Specifically, for the bearing units 14 of the cylinders 06; 07 of printing couples 04 that are located on one side of the web, such as, for example, printing unit section 01.1, a first supply system 75.1, with all the necessary components, for example a first supply line 66.1, a first pressure-reducing valve 64.1, a first pressurized storage tank 63.1 and a first compressor 62.1, can be provided. For the bearing units 14 of the cylinders 06; 07 of printing couples 04 that are located on the other side of the web 02, such as printing unit section 01.2 a second supply system 75.2, with all the necessary components, for example a second supply line 66.2, a second pressure-reducing valve 64.2, a second pressurized storage tank 63.2 and a second compressor 62.2, can be provided. In FIG. 21, the dual arrangement of supply systems for a printing tower 01 is schematically represented.

This dual configuration for each printing tower 01 is especially advantageous in printing towers 01 that are structured as shown in FIG. 2 through 4 to be separable in the area of the printing points 05. In this type of printing tower, for example, all of the bearing units 14 of one printing unit section 01.1 are supplied with pressure medium at the appropriate pressure level P. P1; P2; or P3 by the components of the first supply system, and all of the bearing units 14 of the other printing unit section 01.2 are supplied with pressure medium at the appropriate pressure level P, P1; P2; or P3 by the components of the second supply system. The supply systems may be configured as fully functional pneumatic circuits.

In terms of redundancy, it is particularly advantageous for the two supply systems 75.1; 75.2 to be structured to be optionally connected to one another at least one point. Such a connection should be located downstream from the compressor 62.1; 62.2, and thus in a branch of the supply circuit that has positive pressure in relation to the surrounding air. This can be accomplished, in principle, between the two supply lines 66.1, 66.2 in the area of the already properly adjusted pressure P, P1; P2; or P3 via a valve that can optionally be opened. In the advantageous example shown, however, a connection in the pressure medium branch having the high pressure $P_H$ is created by a line 70 that is equipped with a controllable valve 65. Thus, if one of the two compressors 62.1; 61.2 should fail, the valve 65 will be opened, and the respective other supply line 66.1; 66.2 will also be supplied via the intact compressor 62.1; 62.2.

In the embodiment of the present invention, which is shown in FIG. 11, all four cylinders 06; 07 are mounted such that they can be adjusted to the on/off positions via actuators 43. However, only the stops 41 of the two forme cylinders 07 and of one of the transfer cylinders 06 can be adjusted non-manually, and especially remotely actuatable, such as, for instance, via the pneumatically operated actuators 46. The stop 41 of the other transfer cylinder 06 can be adjusted and can be secured in place, for example via a correcting element 46 that can be implemented as an adjustment screw. Thus, for example, no holding element 69 is necessary.

In a previously-described simpler variation, all four cylinders 06; 07 are mounted so as to be linearly movable via actuators 43, however only the two transfer cylinders 06 have movable stops 41, if applicable, with the aforementioned actuators 46 and/or holding elements 69.

In a further simplified embodiment of the present invention, although one of the two transfer cylinders 06 can be adjusted in its position, it is not functionally movable in the sense of an on/off adjusting movement. Rather, it is mounted, fixed to the frame. The three other cylinders 06; 07 are then movably mounted in the sense of an on/off adjusting movement. In a first variation all of these three cylinders 06, 07, and in a second variation only the transfer cylinder 06 that differs from the fixed transfer cylinder 06, have a movable stop 41 and, if applicable, the holding element 69.

Figure 12:
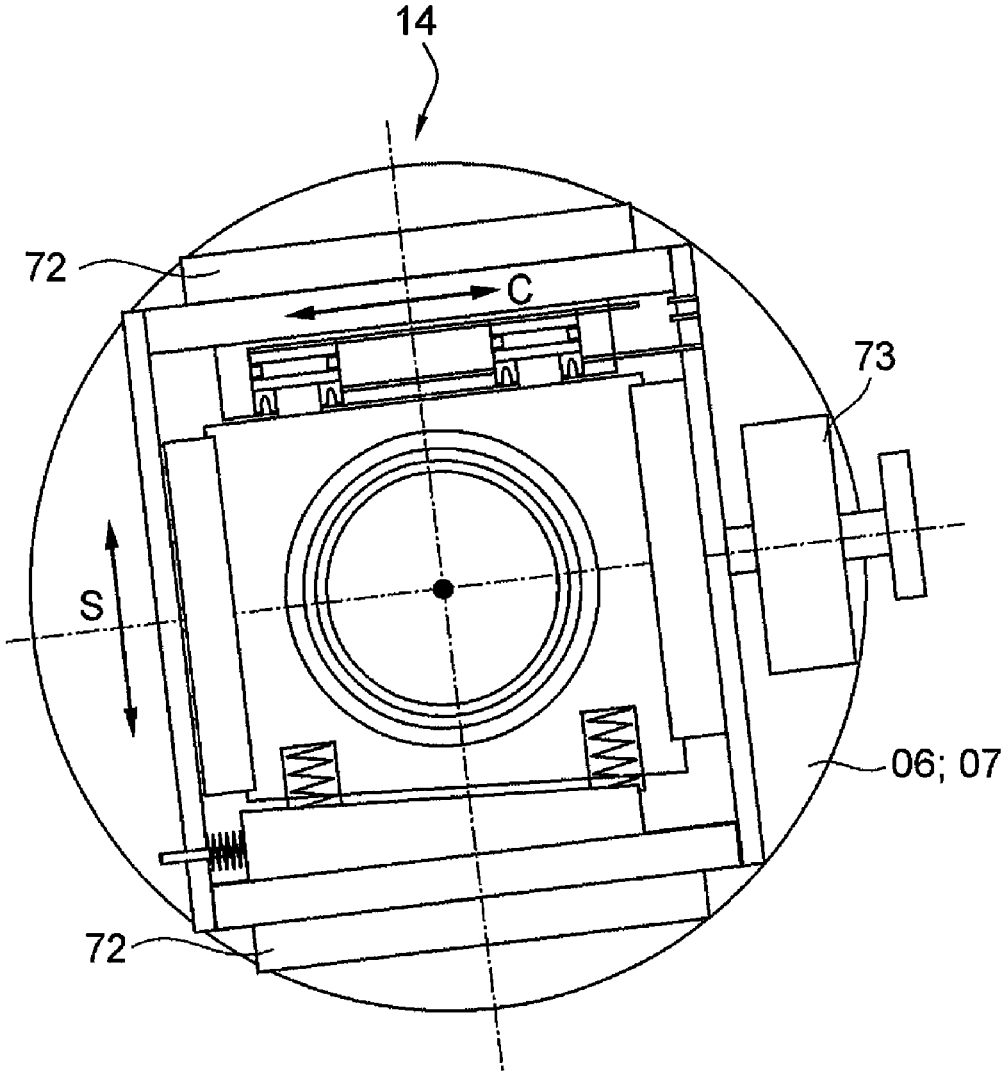
FIG. 12 a bearing unit with an assemblage for use in tilting a cylinder.

In a further development of the cylinder mounting in accordance with the present invention, the bearing units 14 of the forme cylinder 07 and/or of the transfer cylinder 06, as schematically illustrated in FIG. 12, are themselves movably mounted, on at least one end surface, in bearings 72, such as, for example, in linear bearings 72, such that they are movable in one direction of motion C, which extends perpendicular to the axis of cylindrical rotation and which has at least one component that is perpendicular to the direction of adjustment S. The direction of motion C is preferably selected to be perpendicular to the direction of adjustment S, and, with a single-side actuation, effects an inclination, or a so-called "cocking" of the relevant cylinder 06; 07. The cylinder 06; 07 can be adjusted via a manual or a motorized correcting element 73, such as, for example, via a handwheel or preferably via a motorized adjustment screw. This type of additional mounting of the bearing unit or units 14 on the forme cylinder 07 enables an inclination of the forme cylinder 07, and a register adjustment, and enables its inclination relative to the transfer cylinder 06.

Figure 14:
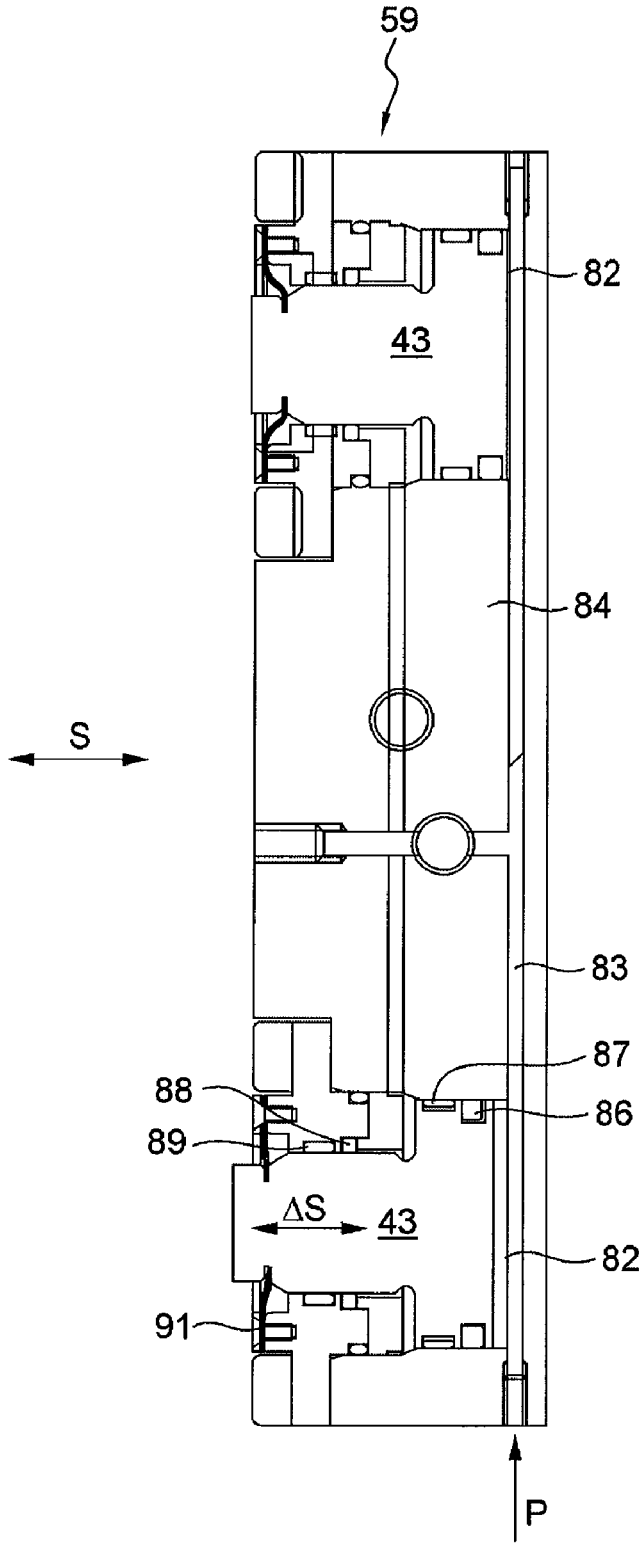
FIG. 14 an embodiment of an actuator element in accordance with the present invention.

In addition, the actuator 43, as provided in the preceding embodiment of the bearing units 14, is configured to provide an adjustment path ΔS that is suitable for on or off adjustment, and thus preferably has a linear stroke which corresponds at least to ΔS. The actuator 43 is provided for adjusting the engagement pressure of rollers or cylinders 06, 07, which are engaged against one another and/or for performing the adjustment to the print-on/print-off position, and is configured accordingly. The adjustment path ΔS, or the linear stroke amounts, for example, to at least 1 mm, advantageously to at least 1.5 mm, and especially to at least 2 mm. In FIG. 14 an advantageous embodiment of an actuator element 59, for example configured as a preassembled component, is represented. This actuator element 59 comprises at least one, and preferably two, pneumatically operated actuators 43, which are configured as pistons 43, and which are mounted, so as to be movable in the direction of adjustment S, in recesses 82 formed in a base component 84 and that serve as pneumatic pressure chambers 82. The actuator element 59 also comprises a supply line 83 for supplying the pressure chambers 82 with pressure medium at the pressure P. Preferably, the two pressure chambers 82 are supplied via a shared supply line, and thus are pressurized or are depressurized in the same manner. In FIG. 14, however, the upper piston 43 is represented, by way of example for both pistons 43, in an inserted position, and the lower piston is represented by way of example for both pistons 43 in a retracted position. For this reason, the supply line 83 has also been characterized as being only partly acted upon by pressure medium.

The piston 43 is sealed against the pneumatic chamber 82 by a seal 86 which, as seen in FIG. 14, is positioned near the pneumatic chamber and which seal 86 is extending around the circumference of the piston 43, and is guided by a sliding guide 87 that is positioned near the pneumatic chamber. A second seal 88 and a second sliding guide 89 can also advantageously be provided in an area of the piston 43 that is distant from the pneumatic chamber. In a particularly advantageous embodiment, in place of, or in addition to the second seal 88, the piston 43 is also sealed against the outside by a membrane 91, which may be, for example, made of rubber, and which especially may be a roller membrane 91. This membrane 91 is connected on one side, all the way around, to the piston 43, and on the other side, on its outer peripheral line, membrane 91 is fully connected to the base component 84 or to other stationary internal parts of the actuator element 59.

Figure 16:
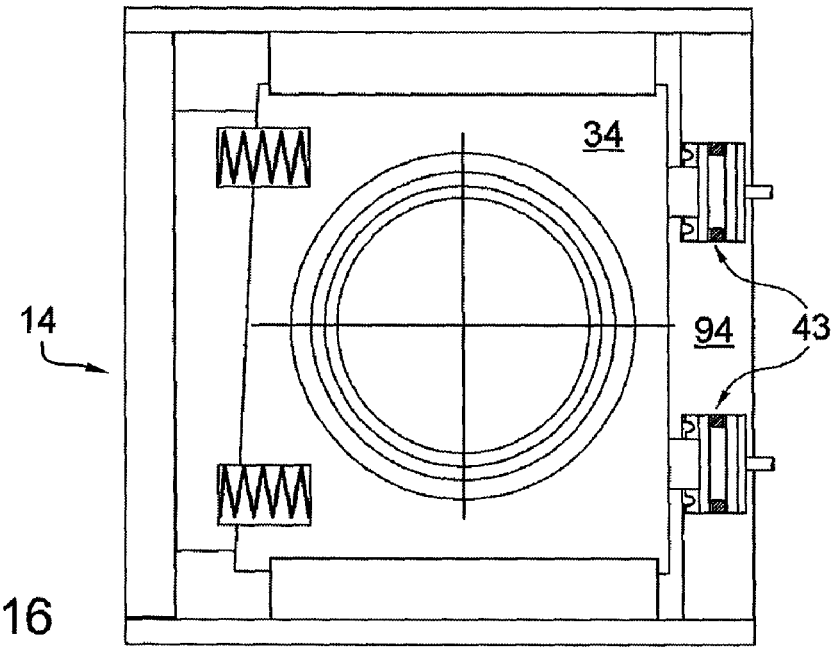
FIG. 16 a second embodiment of the bearing unit.

In a further advantageous embodiment of the bearing unit 14, as is shown in FIG. 16, and in contrast to the first embodiment, the actuators 43 are not integrated into a special actuator element 59, but are integrated into the frame construction, such as, for example, in the side supports 94 that are distant from the printing points. In this configuration, in the embodiment in which the actuators are configured as pneumatically operated actuators 43, the pneumatic cylinders can be provided as boreholes in the side supports 94. The intakes into each pneumatic chamber can also be configured as boreholes in the side support 94. However, power-controllable actuators 43 of other configurations, typically ones based upon hydraulic, magnetic or piezoelectric forces can also be provided, integrated into the side supports 94. Those parts, that obviously coincide with the corresponding components in FIG. 7, are not identified by separate reference symbols in FIG. 16. This configuration is compact and therefore is suitable for use in adjusting cylinders 06; 07 having a small circumference, such as, for example, in cylinders with a single circumference, i.e. with a circumference corresponding to only one newspaper page. In terms of the arrangement of the bearing units 14 in the printing unit 01, their control, and the adjustment and basic setting procedure, the discussion with reference to the first embodiment of the bearing unit 14 applies accordingly.

Figure 17:
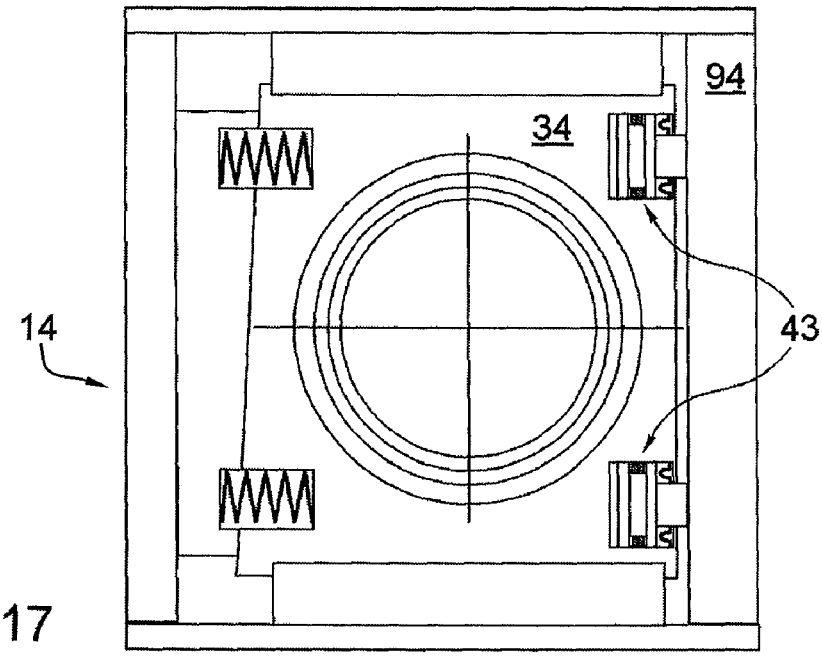
FIG. 17 a third embodiment of the bearing unit.

In a third advantageous embodiment of the bearing unit 14, as shown in FIG. 17, and in contrast to the first embodiment, the actuators 43 are integrated not into the stationary part of the bearing unit 14, but into a movable part of the bearing unit, such as, for example, into the sliding frame 34 or into the bearing block 34. This is a compact arrangement and is therefore particularly well suited for use in adjusting cylinders 06; 07 having a small circumference, for example with a single circumference, such as a circumference corresponding to only one newspaper page. This is true, regardless of whether the power-controllable actuator 43 is specially configured as one that is based upon hydraulic, magnetic or piezoelectric forces. Also, in FIG. 17, and also in FIG. 16, those parts that are shown, and which correspond with the corresponding components in FIG. 7, are not identified by specific reference symbols. In terms of the arrangement of the bearing units 14 in the printing unit 01, their control, and the adjustment and basic setting procedure, what was discussed previously, in reference to the first embodiment of the bearing unit 14, applies accordingly.

Figure 18:
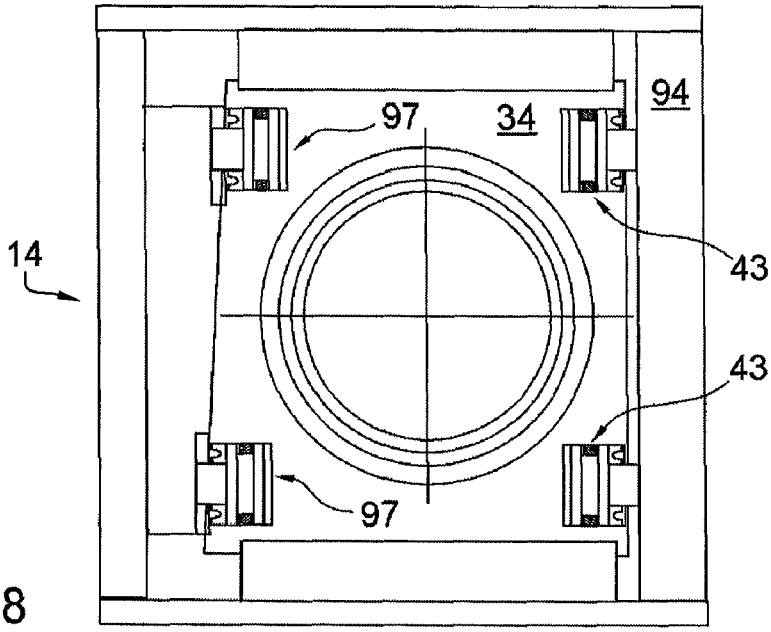
FIG. 18 a fourth embodiment of the bearing unit.
Figure 19:
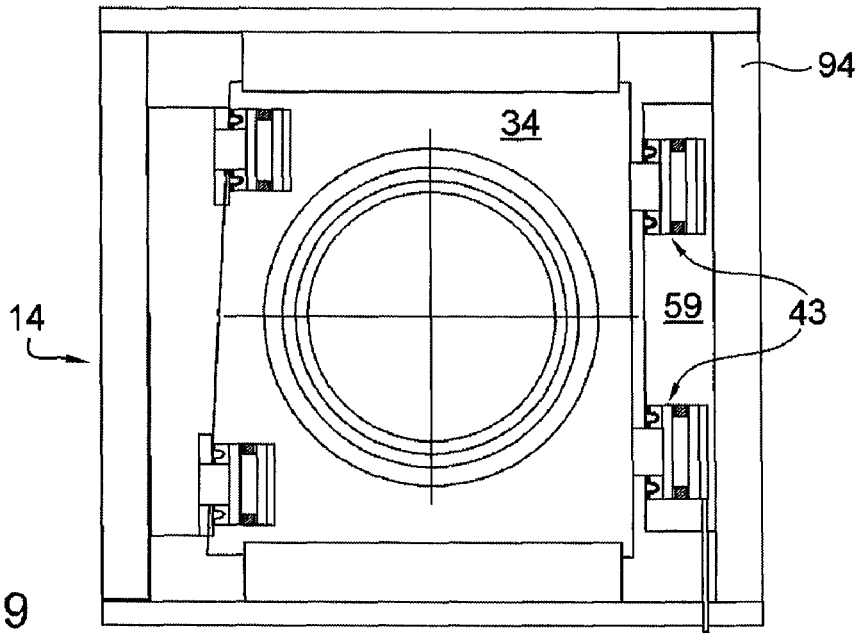
FIG. 19 a fifth embodiment of the bearing unit.

FIGS. 18 and 19 show additional embodiments of the bearing unit 14, wherein, in addition to at least one actuator 43 that is distant from the printing point, at least one actuator 97 is arranged close to the printing point. Formulated in general terms, at least one, and in this case two actuators 43 that act toward the printing point 05, when they are activated, and at least one, and in this case two actuators 97 that act away from the printing point 05, when they are activated, are therefore provided. The actuators 97 are arranged between the movable parts and the stationary parts of the bearing unit 14 such that, when they are activated, a force can be applied to the movable part of the bearing unit 14 in a direction directed away from the printing point 05. The actuators 43 are arranged, as in the preceding examples of the bearing unit 14, between the movable and the stationary parts of the bearing unit 14 such that, when activated, a force can be applied to the movable part of the bearing unit 14 in a direction toward the printing point 05. The actuators 97 can, as shown in FIGS. 18 and 19, be integrated into either the movable part, such as, for example, the sliding frame 34 or into a part of the bearing unit 14 that is stationarily fixed to the frame. The at least one actuator 97 is preferably also configured as a power-controllable actuator, which is based upon hydraulic, magnetic or piezoelectric forces.

In FIG. 18, the actuators 43, which are positioned distant from the printing points, are again integrated into the movable part of the bearing unit 14, such as, for example, in the sliding frame 34, whereas in FIG. 19 they are a part of an actuator element 59 that is stationarily fixed to the frame. However, they can also be integrated into the frame, as is shown in FIG. 16.

In a variation of the present invention that is not specifically shown, in place of the two single-action actuators 43; 97, a dual-action actuator can be used, which dual-action actuator can be activated optionally toward the printing point or away from the printing point, i.e. it can be acted upon by the corresponding pressure medium.

Figure 20:
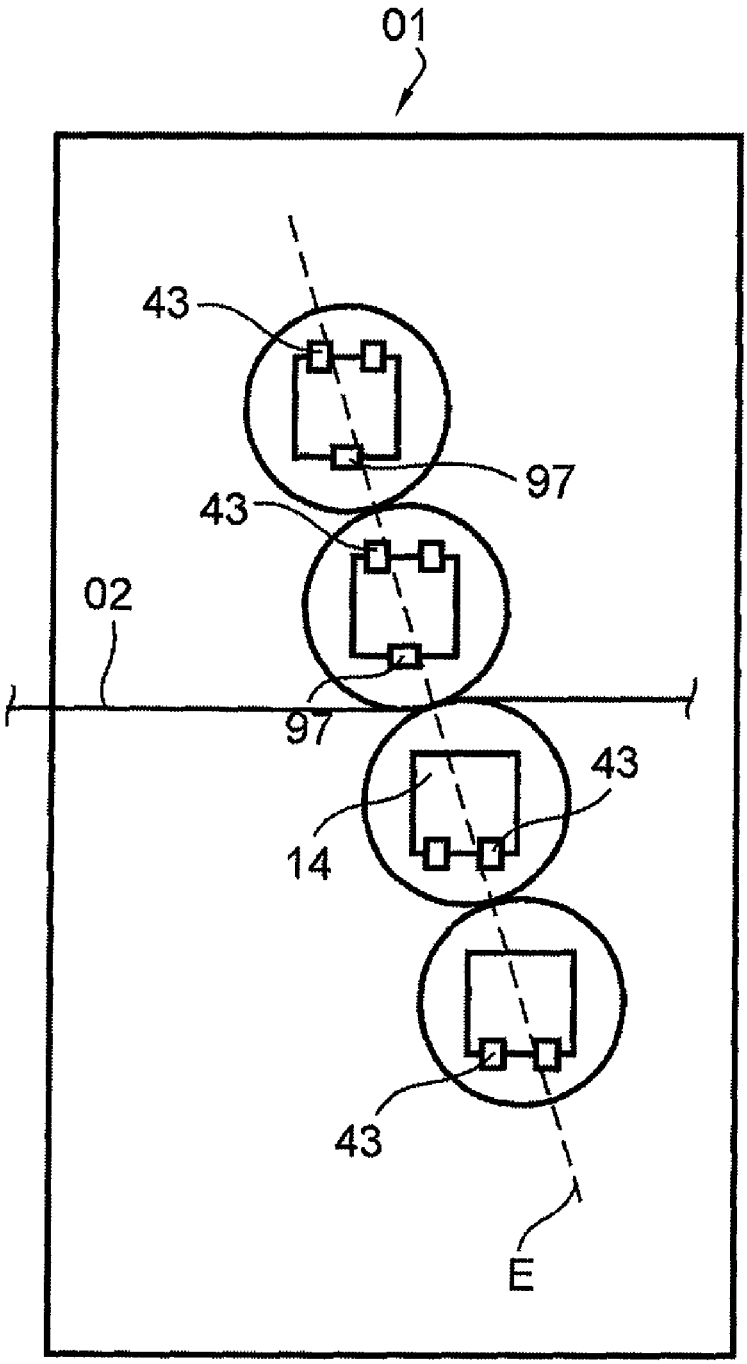
FIG. 20 a schematic representation of an I-printing unit.

The variations of the present invention, which are shown in FIGS. 18 and 19, and with at least one actuator 43 that acts toward the printing point 05 and at least one actuator 97 that acts away from the printing point, or with one dual-action actuator, which is not shown, are particularly advantageous in printing couples 03 or in blanket-to-blanket printing couples 04 whose cylinders 06; 07 are oriented essentially in a vertical arrangement, with or without a slight horizontal offset in relation to one another. This additional actuator 97 can be used, for example, to compensate for the permanent weight of the cylinders. This is especially the case with printing units 01 which are configured as I-printing units 01, as are used, for example, in commercial printing. FIG. 20 is a schematic view of an arrangement of the cylinders 06, 07 in an I-printing unit of this type, with the bearing units 14. In FIG. 20, the cylinders 06; 07 of the I-printing unit 01 are arranged one above another in a single plane, similar to the plane E in FIG. 2. This plane then also forms, for example, an angle that measures between 76° and 87°, and especially between 80° and 85°, with the plane of the web being fed in horizontally. In principle, however, the arrangement can also be configured differently from a planar arrangement. As shown in FIG. 20, by way of example, the two upper cylinders 06; 07, for example, have one or more second actuators 97 on the side of the bearing unit 14 that is near the printing points. These second actuators 97 can compensate for the permanent cylinder weight, for example, at the corresponding pressure level. The lower cylinders 06; 07 in this case have no second actuators 97. In the print-on position, however, these lower cylinders 06; 07 must be adjusted with a level of pressure that is higher by an amount that corresponds to the permanent weight than is required for the upper cylinders 06; 07.

The power-controlled adjustment, or the implementation of a purely force-based pre-adjustment of a stop, as described above, in contrast to path-controlled adjustment, provides an automatic compensation for different substrate thicknesses or for other geometric factors. For a thicker printing substrate or web 02, while the same engagement pressure is maintained, the engagement path is simply shorter than with a thinner substrate or web 02. In other words, changing geometries, such as substrate thicknesses, position of the bearing, and the like are compensated for in that, with the same engagement pressure P, the resulting adjustment path changes. This differs from the embodiment of the present invention, which will be described in what follows, in which for different conditions, different adjustment forces are applied.

As described above with reference to FIG. 11, and regarding the different pressure levels P1, P2 and P3, it can be provided, in a particularly advantageous further improvement, that pressure levels P1, P2, P3 or the resulting force levels that differ from one another can be provided for adjustment of the cylinders 06; 07, based upon certain machine data and/or based on certain consumable product data and/or based on certain operational data, and preferably corresponding default values can be stored.

The adjustable "pressure levels" refer here, in a generalization of the concrete, present advantageous example, as adjustable "force levels" for the contact force, and can be conceptually applied accordingly in a generalization of the teaching of the present invention.

The previously-described process method for adjusting the cylinders 06; 07 can then essentially be maintained. It would be preceded, for example, by only a program-supported or a manual selection of the relevant pressure level P; P1; P2; P3 from a plurality of possible levels with respect to the criterion used to determine the level to be adjusted, such as, for example, printing substrate and/or blanket. Of particular advantage is an embodiment in which a default value for the pressure level P; P1; P2; P3 is predetermined based upon a property, and especially based on a surface property, of the web of material 02 to be printed, and/or based upon the blanket used, and especially based on properties of blankets obtained from different manufacturers. Basic values for a pressure level P; P1; P2; P3 to be set, which values are differing from one another, are allocated to a plurality of possible input values for the relevant criterion, such as, for example, material web 02 or printing blanket.

This allocation between criterion and basic value can be available as information to the printing facility operating personnel, for example, in tabular form. The basic value for the printing level P; P1; P2; P3 that is allocated to the input value for the criterion can then be input accordingly, for example as a target value for printing, by using an input assembly at the control center. In one advantageous embodiment, however, the corresponding allocations between the possible "input values", such as, for example, paper types or blanket types and the recommended or preset "basic values" for the pressure level P; P1; P2; P3 are stored in a data storage unit in the control device 98 or in the control center computer 104, and can be displayed on a display unit and can be selected using an input element.

In the discussion which follows, the process sequence will be detailed using the example of selecting the pressure levels P1, P2, P3. In principle, however, this can be applied to other physical variables based upon the embodiment of the power-controllable actuator that is used. The variable to be controlled can then, for example, be the current intensity, the electric voltage, an electrical line, or other physical variables that determine the variable of power generation. What is important is that different resulting adjustment forces can be allocated to different input values for the relevant criterion, such as material web and/or printing blanket. In the discussion which follows, the adjustable "pressure level" thus stands for the adjustable contact force. Thus, for two or more different input values, different pressure levels or different contact forces are provided or are exerted or are preset for the relevant actuators 43.

Figure 22:
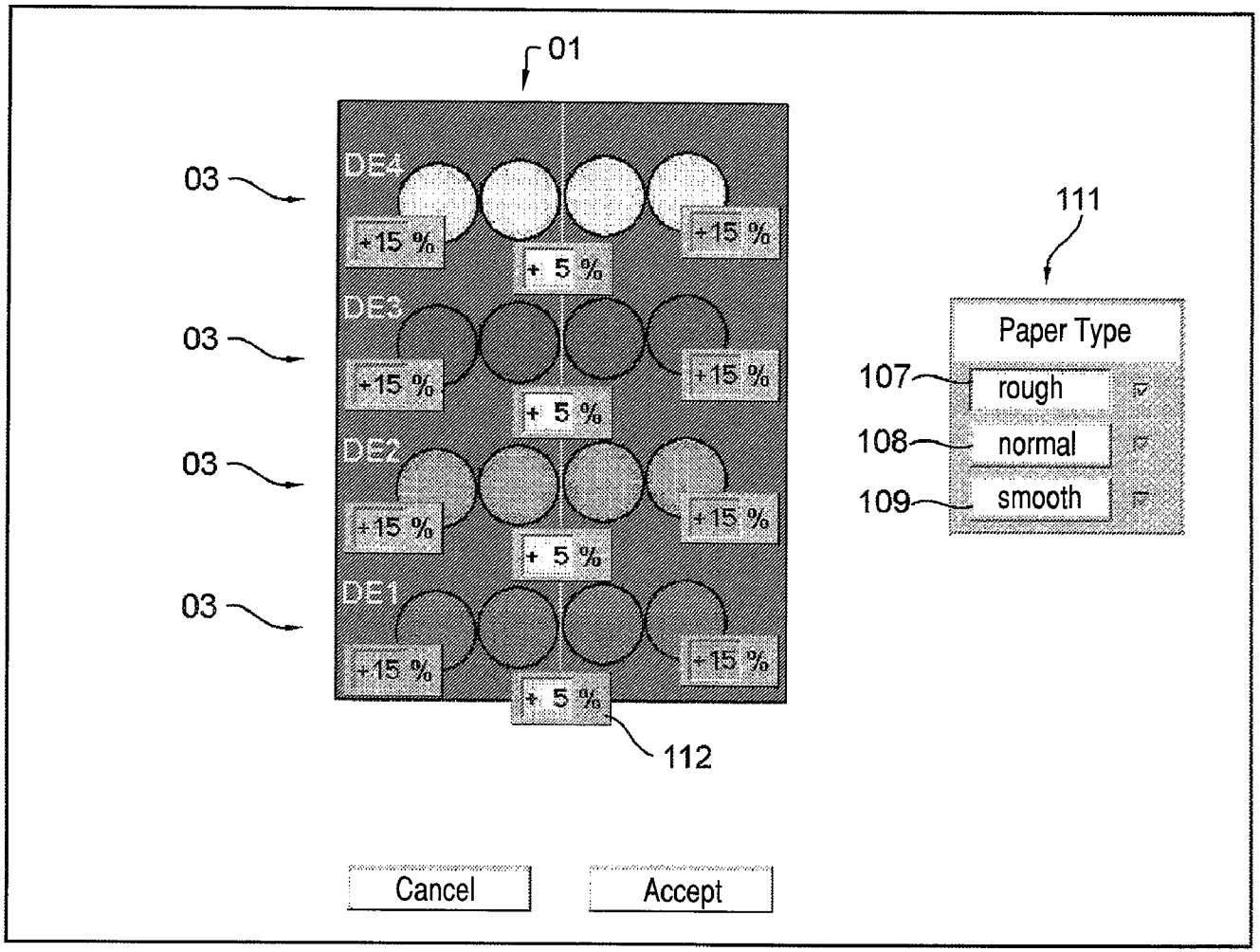
FIG. 22 an example of a first program mask for selecting the criterion "paper type"; and in FIG. 23 an example of a second program mask for selecting the criteria "paper type"; and "blanket type".
Figure 23:
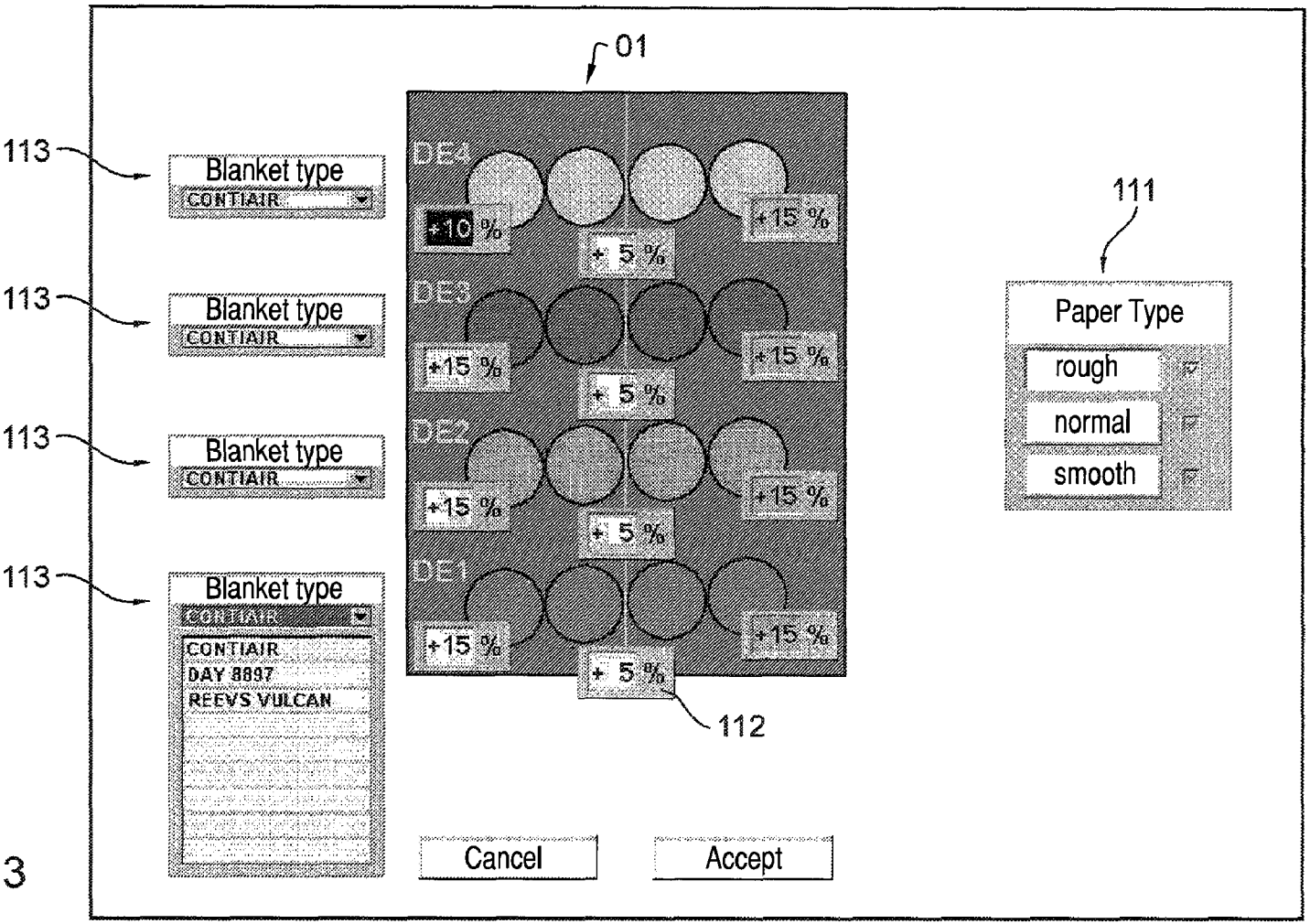

FIGS. 22 and 23 each show, by way of example, at least one section of a program mask that is displayed or that is at least displayable on the display device of the control unit 98 that is part of the control device 98, on the control center 104 or on the control center computer 104. Each of these program masks, in connection with at least one control or input device, such as, for example, a keyboard or a pointer instrument that is part of the control device 98, is used to individually adjust, as needed, the contact force which is exerted, for example, by a cylinder 06; 07 in a roller strip on an adjacent rotational body, and to change an existing adjustment preferably remotely, for example even when the printing couple 04 is in a production run. Each of the program masks shows a schematic view, by way of example, of a printing unit 01 which is configured as a four-high tower. Four blanket-to-blanket printing couples 03 are shown positioned vertically, one above another, for generating a 4/4 print, and wherein the respective transfer cylinders 06 of the blanket-to-blanket printing couples 03 are engaged against one another. One forme cylinder 07 is engaged against a respective one of each of the transfer cylinders 06 of the blanket-to-blanket printing couples 03. For details regarding the configuration of these blanket-to-blanket printing couples 03, reference is again made to FIG. 1 through 4, together with the associated descriptions.

To adjust the contact force which is exerted between the transfer cylinders 06 of the blanket-to-blanket printing couples 03, a plurality of pressure levels P1, P2, P3, for example three, such pressure levers that differ in terms of their individual levels can be provided, with each of these pressure levels P1, P2, P3 being selected based, for example, upon a surface property of the substrate which is being printed in the printing unit 01, and especially based on the web of material 02, as a criterion. The surface property typically refers, for example, to the roughness and/or to the smoothness and/or to the evenness of the surface and/or to its ability to accept ink and/or to the absorptive capacity of the printing substrate 02 and/or to the line count, if the surface of the substrate 02 is lined. For example, in order to generate good print quality on rough newsprint, a contact force that is three to four times greater than a contact force that is required for a very smooth supercalendared paper is necessary. The pressure level P1, P2, P3 that is based upon the surface property of the printing substrate 02 can be conveniently selected, for example, using buttons 107; 108; 109 which are displayed, or which at least are displayable in the program mask, as seen in FIGS. 22 and 23. In each of the program masks shown in FIGS. 22 and 23, a field 111 entitled "Paper Type" is overlaid, wherein in this field 111, a plurality of selection buttons 107; 108; 109, such as, for example, three such selection buttons, are provided for use in selecting the input value for a paper having a rough or a normal or a smooth surface. A certain value, which preferably is determined by the manufacturer of the printing press and which is not specified in greater detail in the program masks, for the basic value of the pressure level P1; P2; P3, i.e. for the contact force exerted between the transfer cylinders 06 of the blanket-to-blanket printing couples 03, is allocated to each of these selectable input values. The respective contact force which is allocated to one of the pressure levels P1, P2, P3 are adjusted using the actuators 43 that are arranged in the respective bearing unit 14 of the transfer cylinder 06, once the printing press operator has made his decision with respect to the selectable input values. The selection can also be made in another suitable manner, such as, for example, by opening so-called "pull-down" menus and by confirming the selection.

It can further be provided that the contact force which is exerted between the transfer cylinders 06 of the blanket-to-blanket printing couples 03, and which is based upon at least one of the selectable pressure levels P, P1, P2, P3, can preferably be changed from all selectable pressure levels in a fine adjustment. In the example shown in the program masks in FIGS. 22 and 23, the fine adjustment consists in the addition of a percentage stored from the selectable pressure level P, P1, P2, P3 to increase the respective contact force. Such an addition can be implemented, for example, in steps ranging from one percent up to 100% each, and thus can range up to a doubling of the value that corresponds to the respective selected pressure level or the contact force. The addition, which is based upon the respective selected pressure level P, P1, P2, P3, is inserted into a window 112 in the program masks, for example, within the schematically represented printing unit 01, for example, as a numerically displayed percentage which is allocated to the respective transfer cylinders 06 of the blanket-to-blanket printing couples 03. In the example shown in FIGS. 22 and 23, each adjusted addition for all the blanket-to-blanket printing couples 03 is +5%. Of course, values deviating from this, and values that differ among the blanket-to-blanket printing couples 03 can also be adjusted.

In one advantageous embodiment of the present invention, for at least a first paper, whose line weight ranges, for example, from 0 to 10 g/m$^2$ and which is thus unlined or ultralight lined paper and for a second paper that is different from the first, whose line weight, for example, ranges from 10 to 20 g/m$^2$ and which is thus light lined paper, different pressure levels P1, P2 are preset and/or, for example, are stored in the data memory of the control device 98. In addition to the two papers, or in place of one of the two papers, for an additional paper, whose line weight, for example, is over 20 g/m$^2$ and is thus not unlined or ultralight lined paper, a pressure level P3 that is different from the initially mentioned pressures or pressure levels P1, P2 can be preset and/or can be stored, for example, in the data memory of the control device 98. Thus, for at least two papers of different line weights, pressures P1, P2, P3 that are different from one another, or pressure levels P1, P2, P3, are preset.

It can further be provided that the contact force exerted between one of the transfer cylinders 06 and one of the forme cylinders 07 can be changed. The adjustment of the contact force which is exerted between one of the transfer cylinders 06 and one of the forme cylinders 07 is directed at blanket properties, such as, for example, the elasticity and/or the compressibility of the blankets which are mounted on the transfer cylinders 06. FIG. 23 shows that, for example, in addition to the adjustability of the contact force which is exerted between the transfer cylinders 06 of the blanket-to-blanket printing couples 03, each blanket-to-blanket printing couple 03 is preferably assigned a selection menu 113. Each selection menu 113, for example, may have a list containing a plurality of names or identifiers of blankets having different technical properties, and wherein the particular blanket that is mounted on the respective transfer cylinder 06 at a given time can be selected. Based upon the selected blanket, a certain value for the contact force or for the pressure level P, P4, P5, P6, specified for the respective blanket, is set between the respective transfer cylinder 06 and the allocated forme cylinder 07, with each of these settings in turn specifying a certain level for the contact force.

Based upon this pressure level P, P1, P2, P3 that can be selected based upon the blanket, the contact force actually exerted between all of the transfer cylinders 06 and their respective allocated forme cylinders 07 can preferably be changed via a fine adjustment, such a change being implemented, for example, as an addition, for example in steps of one percent to 100% each, up to a doubling of the value that corresponds to the contact force of the respective selected pressure level P, P1, P2, P3. The addition that is based upon the respective selected pressure level is inserted in the program mask in FIG. 23, for example within the schematically represented printing unit 01, for example as a numerically displayed percentage, allocated, for example, to one of the forme cylinders 07 of the blanket-to-blanket printing couple 03, where it can also be changed and/or edited. In the example shown in FIG. 23, the adjusted addition for three of the four blanket-to-blanket printing couples 03 is +15%, and the adjusted addition for the uppermost blanket-to-blanket printing couple 03 is, for example, 10%. Of course, values that deviate from these and values that differ among the blanket-to-blanket printing couples 03 can also be set.

The respective contact force, either pressure or force level allocated to an input value, and its fine adjustment, whether this involves the adjustment of the contact force based upon the surface property of the printing substrate 02 and/or the adjustment of the contact force based upon properties of the blanket that is used, is accomplished in each case by the use of the actuators 43 that are arranged in the respective bearing unit 14 of the transfer cylinder 06 and/or the forme cylinder 07.

The changes in the selection and/or the change in the fine adjustment, for the criterion "paper selection" and/or for the criterion "blanket selection", can be protected by an assignable password through the software on which this is based. The criterion "paper selection" can typically be freely changed. However, the criterion "blanket selection", which is more sensitive in terms of printing technology, can be password protected for safety reasons, with respect to its selection and/or fine adjustment.

Of particular advantage in the use of power-controlled adjustment is the fact that various thicknesses of the material web 02 need not be taken into account in the adjustment. This is automatically taken into account in power-based adjustment, as opposed to path-based adjustment. As described above, it is, however, advantageous to consider the surface property in the adjustment of the contact force and/or the pressure level.

In embodiments in which the pressure levels P, P1, P2, P3 of different cylinders 06; 07 and/or of different printing couples 04 and/or of different blanket-to-blanket printing couples 03 of a printing unit 01 should be individually selectable and/or precision adjustable, in a first embodiment either a plurality of supply systems, such as pneumatic circuits can be provided, or a plurality of controllable pressure-reducing valves 64 in a shared supply line can be provided for each individually adjustable cylinder 06; 07 or group of cylinders.

While preferred embodiments of printing units and methods for adjusting a print-on position, in accordance with the present invention, have been set forth fully and completely hereinabove, it will be apparent to one of skill in the art that various changes in, for example, the specific structures of the printing couple cylinders, the drives for the cylinders and the like can be made without departing from the true spirit and scope of the present invention, which is accordingly to be limited only by the appended claims.

What is claimed is:

1. A newspaper printing press comprising:

a plurality of printing units arranged spaced from each other in a printing tower of said newspaper printing press and usable for double-sided printing of a material web in offset printing;

first and second cooperating printing couples in each of said plurality of printing units;

at least first and second cylinders in each of said printing couples, said first and second cylinders including a forme cylinder and a blanket cylinder, said blanket cylinders of said first and second cooperating printing couples in each of said printing units contacting each other to accomplish said offset printing of said material web passing between said blanket cylinders of said cooperating printing couples of each of said printing units;

means supporting at least one of said blanket cylinders of each of said first and second cooperating printing couples for movement with respect to the other of said blanket cylinders of each of said first and second cooperating printing couples;

at least one power-driven actuator usable to move said at least one blanket cylinder with respect to said other of said blanket cylinders to vary a contact force existing between said first and second blanket cylinders;

a control device usable to adjust said at least one power-driven actuator to vary said contact force between said at least one blanket cylinder and said other of said blanket cylinders in each said printing unit; and a plurality of default values stored in said control device, said plurality of stored default values being different from each other and each being representative of a different level of said contact force provided by said at least one power-driven actuator, each of said plurality of default values being based on a criterion relating to at least a property of the surface of the web of material to be printed, said plurality of default values each being usable to vary said contact force by operation of said at least one power-driven actuator.

2. The newspaper printing press of claim 1 further including input values which characterize an additional property of the material web to be printed, said input values being stored as additional default values, and wherein at least for first and second ones of said input values there are provided at least first and second ones of said default values which represent different levels of said contact force.

3. The newspaper printing press of claim 2 further including input values usable to characterize a degree of roughness of said surface of the material web.

4. The newspaper printing press of claim 1 further including a further default value to represent a contact force for at least two material webs of different line weight.

5. The newspaper printing press of claim 4 wherein for a first material web having a first line weight of from 0 to 10 $g/m^2$ and for a second material web having a second line weight of from 10 $g/m^2$ to 20 $g/m^2$, first and second forces which are different from each other and which represent default values for said contact force are preset.

6. The newspaper printing press of claim 1 wherein each of said blanket cylinders in each of said printing couples has a printing blanket and further including a display device having a program mask with a selection menu of printing blankets, said plurality of default values which each represent a different level of said contact force being stored in said control device for different input values which characterize each said printing blanket, each said printing blanket being selected from said selection menu on said program mask of said display device.

7. The newspaper printing press of claim 6 wherein ones of manufacturer's specifications and specific printing blanket identifiers are stored as input values that characterize each said printing blanket.

8. The newspaper printing press of claim 1 wherein said at least one power-driven actuator is adapted to be acted upon with a preset medium at presettable pressure levels.

9. The newspaper printing press of claim 8 wherein said plurality of default values characterize said presettable pressure levels intended to act on said at least one power-driven actuator.

10. The newspaper printing press of claim 9 further including a control element in a pneumatic circuit, said control element being usable to remotely adjust said presettable pressure levels by use of said control device via said control element.

11. The newspaper printing press of claim 1 wherein said at least one power-driven actuator is adapted to be acted upon with electrical current at presettable levels and is an actuator based on piezoelectric forces.

12. The newspaper printing press of claim 11 wherein said default values characterize voltage levels that differ from one another and which are intended to act on said at least one power-driven actuator.

13. The newspaper printing press of claim 1 wherein said at least one power-driven actuator is adapted to be acted upon with an electrical current intensity at presettable levels and is an actuator based on magnetic forces.

14. The newspaper printing press of claim 13 wherein said default values characterize said electrical current intensities and which are intended to act upon said at least one power-driven actuator.

15. The newspaper printing press of claim 1 further including an input means for said control device and usable to select one of a plurality of possible input values for said contact force.

16. The newspaper printing press of claim 1 wherein said property of said surface of the web of material is a roughness of said surface.

17. The newspaper printing press of claim 1 wherein said property of said surface of the web of material is a smoothness of said surface.

18. The newspaper printing press of claim 1 wherein said property of said surface of the web of material is an ability to accept ink of said surface.

19. The newspaper printing press of claim 1 wherein said property of said surface of the web of material is an absorptive capacity of said surface.

* * * * *